US007937959B2

(12) United States Patent
Tanabe et al.

(10) Patent No.: US 7,937,959 B2
(45) Date of Patent: May 10, 2011

(54) CONTROL SYSTEM, INTEGRATED CONTROL APPARATUS, AND CONTROL PROGRAM

(75) Inventors: Yoshinori Tanabe, Osaka (JP); Atsushi Ouchi, Osaka (JP); Yoshio Ozawa, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 142 days.

(21) Appl. No.: 12/485,490

(22) Filed: Jun. 16, 2009

(65) Prior Publication Data

US 2009/0308089 A1 Dec. 17, 2009

(30) Foreign Application Priority Data

Jun. 16, 2008 (JP) ..... 2008-156515
Sep. 26, 2008 (JP) ..... 2008-249302
Jun. 1, 2009 (JP) ..... 2009-132291

(51) Int. Cl.
*F25D 21/06* (2006.01)

(52) U.S. Cl. ..... 62/155; 62/234

(58) Field of Classification Search ..... 62/151, 62/155, 157, 126, 199, 234; 700/275, 276
See application file for complete search history.

(56) References Cited

U.S. PATENT DOCUMENTS 3,899,896 A * 8/1975 Bryant ..... 62/155
3,937,033 A * 2/1976 Beckwith et al. ..... 62/155
3,992,895 A * 11/1976 Kramer ..... 62/155
4,056,948 A * 11/1977 Goodhouse ..... 62/155
4,151,722 A * 5/1979 Willitts et al. ..... 62/155
4,151,723 A * 5/1979 Gardner ..... 62/155
4,169,358 A * 10/1979 Hansen et al. ..... 62/154
4,206,612 A * 6/1980 Gardner ..... 62/128
4,209,994 A * 7/1980 Mueller et al. ..... 62/155
4,251,988 A * 2/1981 Allard et al. ..... 62/80
4,251,999 A * 2/1981 Tanaka ..... 62/155
4,265,092 A * 5/1981 Abraham ..... 62/155
4,297,852 A * 11/1981 Brooks ..... 62/153
4,302,946 A * 12/1981 Ibrahim ..... 62/82
4,459,815 A * 7/1984 Yokoyama ..... 62/180
4,474,026 A * 10/1984 Mochizuki et al. ..... 62/157
4,474,029 A * 10/1984 Kennon ..... 62/278
4,481,785 A * 11/1984 Tershak et al. ..... 62/153
4,519,215 A * 5/1985 Barnett ..... 62/158
5,415,005 A * 5/1995 Sterber et al. ..... 62/154

FOREIGN PATENT DOCUMENTS

JP 05060450 9/1993

* cited by examiner

*Primary Examiner* — Mohammad M Ali
(74) *Attorney, Agent, or Firm* — NDQ&M Watchstone LLP

(57) ABSTRACT

An object of the present invention is to provide a control system, an integrated control apparatus, and a control program that are capable of well maintaining freshness and quality of food articles, by reducing time for performing a recovery operation following a frost removing operation of cooling devices. In response to a start of the frost removing operation of a first showcase, an integrated control apparatus provides a second device controller (device control unit) with a "lower limit cooling instruction (increase instruction)" to increase the refrigerant supplied to a second showcase to an amount larger than that before the frost removing operation starts. In response to the "lower limit cooling instruction (increase instruction)," the second device controller (device control unit) increases the amount of the refrigerant supplied to the second showcase.

17 Claims, 20 Drawing Sheets

| | FIRST SHOWCASE 53 | SECOND SHOWCASE 54 |
|---|---|---|
| FIRST TIME | 0 : 00 | 4 : 00 |
| SECOND TIME | 8 : 00 | 12 : 00 |
| THIRD TIME | 16 : 00 | 20 : 00 |

| | FIRST SHOWCASE 53 | SECOND SHOWCASE 54 |
|---|---|---|
| UPPER LIMIT TEMPERATURE | $T_{1H}$ | $T_{2H}$ |
| STANDARD TEMPERATURE | $T_{1S}$ | $T_{2S}$ |
| LOWER LIMIT TEMPERATURE | $T_{1L}$ | $T_{2L}$ |

FIG. 6

| TIME | FIRST DEVICE CONTROLLER OPERATION MODE | SECOND DEVICE CONTROLLER OPERATION MODE | FIRST DEVICE CONTROLLER SET TEMPERATURE | SECOND DEVICE CONTROLLER SET TEMPERATURE |
|---|---|---|---|---|
| ... | ... | ... | ... | ... |
| 23:59 | STANDARD COOLING | STANDARD COOLING | $T_{1S}$ | $T_{2S}$ |
| 0:00 | FROST REMOVAL | LOWER LIMIT COOLING | – | $T_{2L}$ |
| ... | ... | ... | ... | ... |
| 0:29 | FROST REMOVAL | LOWER LIMIT COOLING | – | $T_{2L}$ |
| 0:30 | RECOVERY | UPPER LIMIT COOLING | $T_{1S}$ | $T_{2H}$ |
| ... | ... | ... | ... | ... |
| 0:44 | RECOVERY | UPPER LIMIT COOLING | $T_{1S}$ | $T_{2H}$ |
| 0:45 | STANDARD COOLING | STANDARD COOLING | $T_{1S}$ | $T_{2S}$ |
| ... | ... | ... | ... | ... |

| | FIRST SHOWCASE 53 | SECOND SHOWCASE 54 | THIRD SHOWCASE 55 |
|---|---|---|---|
| FIRST TIME | 0 : 00 | 3 : 00 | 6 : 00 |
| SECOND TIME | 9 : 00 | 12 : 00 | 15 : 00 |
| THIRD TIME | 17 : 00 | 19 : 00 | 21 : 00 |

| | FIRST SHOWCASE 53 | SECOND SHOWCASE 54 | THIRD SHOWCASE 55 |
|---|---|---|---|
| UPPER LIMIT TEMPERATURE | $T_{1H}$ | $T_{2H}$ | $T_{3H}$ |
| STANDARD TEMPERATURE | $T_{1S}$ | $T_{2S}$ | $T_{3S}$ |
| LOWER LIMIT TEMPERATURE | $T_{1L}$ | $T_{2L}$ | $T_{3L}$ |

SELECTION OF SHOWCASE WHOSE TIME REQUIRED FOR TEMPERATURE RISE IS MEASURED

| SELECTION | SHOWCASE NO. | AVERAGE RECOVERY TIME | ARTICLES |
|---|---|---|---|
| ✓ | FIRST SHOWCASE 53 | 30 MINUTES | DAIRY PRODUCTS |
| ✓ | SECOND SHOWCASE 54 | 40 MINUTES | FROZEN FOOD |
| ✓ | THIRD SHOWCASE 55 | 30 MINUTES | VEGETABLES |

DETERMINE CANCEL

| AMBIENT TEMPERATURE | $t_{R1}$ | $t_{R2}$ | $t_{R3}$ |
|---|---|---|---|
| 15°C | 25 MINUTES | 37 MINUTES | 21 MINUTES |
| 17°C | 23 MINUTES | 36 MINUTES | 19 MINUTES |
| 19°C | 21 MINUTES | 35 MINUTES | 17 MINUTES |
| 21°C | 20 MINUTES | 34 MINUTES | 15 MINUTES |

FIG. 24

TARGET OF FROST REMOVAL: FIRST SHOWCASE 53
(AVERAGE RECOVERY TIME: 30 MINUTES)

| SELECTION | SHOWCASE No. | $t_R$ | ARTICLES |
|---|---|---|---|
| ✕ | FIRST SHOWCASE 53 | — | DAIRY PRODUCTS |
| ✓ | SECOND SHOWCASE 54 | 35 MINUTES | FROZEN FOOD |
| | THIRD SHOWCASE 55 | 19 MINUTES | VEGETABLES |

DETERMINE CANCEL

FIG. 27

| SHOWCASE No. | DEVICE TYPE CODE | ARTICLES |
|---|---|---|
| FIRST SHOWCASE 53 | SC30 | DAIRY PRODUCTS |
| SECOND SHOWCASE 54 | SC31 | FROZEN FOOD |
| THIRD SHOWCASE 55 | SC35 | VEGETABLES |

FIG. 28

| DEVICE TYPE CODE | DEVICE TYPE PARAMETER Pt |
|---|---|
| SC30 | 0.3 |
| SC31 | 0.3 |
| SC35 | 0.9 |

FIG. 29

| ARTICLES | ARTICLE PARAMETER Pg |
|---|---|
| VEGETABLES | 0.4 |
| DAIRY PRODUCTS | 0.5 |
| FROZEN FOOD | 0.7 |

FIG. 31

| | | TARGET TO BE NOTIFIED | | |
|---|---|---|---|---|
| | | FIRST SHOWCASE 53 | SECOND SHOWCASE 54 | THIRD SHOWCASE 55 |
| TARGET OF FROST REMOVAL | FIRST SHOWCASE 53 | | 25 MINUTES | 35 MINUTES |
| | SECOND SHOWCASE 54 | 30 MINUTES | | 38 MINUTES |
| | THIRD SHOWCASE 55 | 25 MINUTES | 20 MINUTES | |

CONTROL SYSTEM, INTEGRATED CONTROL APPARATUS, AND CONTROL PROGRAM

CROSS REFERENCE TO RELATED APPLICATIONS

This application is based upon and claims the benefit of priority from prior Japanese Patent Application No. 2008-156515, filed on Jun. 16, 2008; and prior Japanese Patent Application No. 2008-249302, filed on Sep. 26, 2008; and prior Japanese Patent Application No. 2009-132291, filed on Jun. 1, 2009; the entire contents of which are incorporated herein by reference.

BACKGROUND OF THE INVENTION

1. Field of the Invention

The present invention relates to a control system including a cooling device for cooling a cooled space, an integrated control apparatus for controlling the cooling device, and a control program used in the integrated control apparatus.

2. Description of the Related Art

Conventionally, a cooling device for cooling a cooled space, for example, a showcase installed in a shop such as a supermarket or a convenience store or the like, is widely used. Usually, in such a shop, multiple cooling devices are installed, and the plurality of cooled spaces of the multiple cooling devices are cooled by a refrigerant supplied through the same piping. In the case of the showcase, for example, the cooled space refers to the inside of a compartment where food articles are displayed. Since moisture in the air attaches as frost to such a cooling device, a frost removing operation (a defrosting operation) for removing the frost attached to the cooling device is performed by regularly raising a temperature of the cooling device. In addition, the frost attached to the cooling device refers to the frost attached to an evaporator (a heat sink) to which the refrigerant is supplied. Regularly removing the frost attached to the evaporator well maintains cooling capability of the evaporator.

The frost removing operation herein is, for example, an operation for removing the frost by stopping flow of the refrigerant using a solenoid valve and by heating the evaporator using a heater. When such a defrosting operation is performed, the temperature of the cooled space is elevated. Thus, after the frost removing operation ends, a recovery operation (a pull-down operation) is performed to lower the elevated temperature in the cooled space to a predetermined temperature.

In the recovery operation, in order to maintain freshness or quality of the food articles displayed in the compartment, it is desirable to promptly lower the temperature of the cooled space to the predetermined temperature. That is to say, it is desirable that time for performing the recovery operation should be short. To this end, a technique is proposed in which, in a cooling device comprising a main evaporator and an auxiliary evaporator, the auxiliary evaporator cools a cooled space while the frost removing operation for removing the frost attached to the main evaporator is performed (See, Japanese Patent Application Publication No. Hei 5-60450). With this technique, time for performing the recovery operation can be reduced by suppressing a temperature rise in the cooled space while the frost removing operation is performed.

SUMMARY OF THE INVENTION

There is a problem, however, that manufacturing cost of a cooling device increases because the above technique requires at least two evaporators to be provided in the cooling device.

Hence, the present invention has been made to solve the problem described above, and an object of the present invention is to provide a control system, an integrated control apparatus, and a control program that are capable of well maintaining freshness and quality of food articles by reducing time for performing a recovery operation after a frost removing operation of a cooling device.

In summary, a control system according to the present invention includes a first cooling device configured to cool a first cooled space; a second cooling device configured to cool a second cooled space; a refrigerant supplying device configured to supply a refrigerant to the first cooling device and the second cooling device; an integrated control apparatus configured to detect or control a frost removing operation for removing frost attached to the first cooling device; and a device control unit configured to control an amount of the refrigerant supplied to the second cooling device, wherein the integrated control apparatus includes a transmitter for transmitting an increase instruction to the device control unit in response to a start of the frost removing operation, the increase instruction instructing the device control unit to increase the refrigerant supplied to the second cooling device, to an amount larger than that before the frost removing operation starts, and the device control unit increases the amount of the refrigerant supplied to the second cooling device, according to the increase instruction.

In the control system according to the present invention, in response to the end of the frost removing operation, the transmitter may transmit a decrease instruction to the device control unit, the decrease instruction instructing the device control unit to decrease the refrigerant supplied to the second cooling device, to an amount smaller than that before the frost removing operation ends, and the device control unit reduces the amount of the refrigerant supplied to the second cooling device, according to the decrease instruction.

The control system according to the present invention may further include a valve capable of adjusting the amount of the refrigerant supplied to the second cooling device, wherein the device control unit may control an aperture ratio of the valve according to the instruction.

In the control system according to the present invention, the instruction may include temperature information indicating a set temperature in the second cooled space, and the device control unit may control the aperture ratio of the valve according to the temperature information.

In the control system according to the present invention, the device control unit may compute the aperture ratio on the basis of an opening area of the valve.

In the control system according to the present invention, the device control unit may compute the aperture ratio on the basis of opening time per unit time of the valve.

The control system according to the present invention may include a third cooling device configured to cool a third cooled space; and an another device control unit configured to control an amount of the refrigerant supplied to the third cooing device, wherein when a temperature in the second cooled space reaches a predetermined temperature, the transmitter transmits an decrease instruction to the another device control unit, the decrease instruction instructing the another device control unit to decrease the amount of the refrigerant supplied to the third cooling device, and the another device control unit decreases the amount of the refrigerant supplied to the third cooling device, according to the decrease instruction to decrease the amount of the refrigerant supplied to the third cooling device.

The control system according to the present invention may include a plurality of cooling devices that include the second cooling device and that are configured to respectively cool a plurality of cooled spaces including the second cooled space, wherein the integrated control apparatus may further include a selector for selecting, from the plurality of cooling devices, the second cooling device as a cooling device having relatively high thermal stability under a condition with a decreased amount of the refrigerant supplied.

In the control system according to the present invention, in response to the end of the frost removing operation, the transmitter may transmit a decrease instruction to the device control unit, the decrease instruction instructing the device control unit to decrease the refrigerant supplied to the second cooling device, to an amount smaller than that before the frost removing operation, and the device control unit may decrease the amount of the refrigerant supplied to the second cooling device, according to the decrease instruction.

In the control system according to the present invention, the integrated control apparatus may include a measurement unit configured to measure time required for temperature rise for each of the plurality of cooling devices, the time required for temperature rise being time required to raise a temperature in each of the plurality of cooled spaces from a lower limit temperature to an upper limit temperature, the lower and upper limit temperatures being specified for each of the plurality of cooled spaces, and the selector may select a cooling device having the time required for temperature rise that is relatively long, as the second cooling device.

In the control system according to the present invention, the integrated control apparatus may include a memory unit configured to store, for each of the plurality of cooling devices, an ambient temperature and the time required for temperature rise in association with each other, the ambient temperature being obtained when the time required for temperature rise is measured, and the selector may make a selection from the plurality of cooling devices on the basis of their respective times required for temperature rise that are associated with the ambient temperatures at a time of start of the frost removing operation, and thus selects as the second cooling device a cooling device having the relatively long time required for temperature rise.

In the control system according to the present invention, the selector may compute the thermal stability of each of the plurality of cooling devices, on the basis of the turnover quantity of articles displayed in each of the plurality of cooled spaces.

In the control system according to the present invention, the selector may include a memory unit in which the second cooling device is registered, and the selector selects the second cooling device registered in the memory unit, as a target to transmit the increase instruction during a frost removing operation of next time.

An integrated control apparatus according to the present invention is summarized in that it is an integrated control apparatus configured to detect or control a frost removing operation in which frost attached to a first cooling device that cools a first cooled space is removed while the first cooled space is receiving supply of refrigerant from a refrigerant supplying device that supplies the refrigerant to a second cooling device that cools a second cooled space, the integrated control apparatus comprising a transmitter configured to provide a device control unit with an increase instruction in response to start of the frost removing operation, the device control unit configured to control an amount of the refrigerant supplied to the second cooling device, the increase instruction instructing the device controller to increase the refrigerant supplied to the second cooling device, to an amount larger than that before the frost removing operation starts.

The integrated control apparatus according to the present invention may include a selector configured to select the second cooling device as a cooling device having relatively high thermal stability under a condition with a decreased amount of the refrigerant supplied, from a plurality of cooling devices that include the second cooling device and that are configured to respectively cool a plurality of cooled spaces including the second cooled space.

A control method according to the present invention is summarized that it is a control method used in a control system including a first cooling device configured to cool a first cooled space, a second cooling device configured to cool a second cooled space, a refrigerant supplying device configured to supply a refrigerant to the first cooling device and the second cooling device, an integrated control apparatus configured to detect or control a frost removing operation for removing frost attached to the first cooling device; and a device control unit configured to control an amount of the refrigerant supplied to the second cooling device, the method comprising the steps of: causing the integrated control apparatus to provide the device control unit with an increase instruction in response to a start of the frost removing operation, the increase instruction instructing the device control unit to increase the refrigerant supplied to the second cooling device, to an amount larger than that before the frost removing operation starts; and causing the device control unit to increase the amount of the refrigerant supplied to the second cooling device, according to the increase instruction.

A control program according to the present invention is summarized in that it is a control program used in a computer functioning as an integrated control apparatus configured to detect or control a frost removing operation in which frost attached to a first cooling device that cools a first cooled space is removed while the first cooled space is receiving supply of refrigerant from a refrigerant supplying device that supplies the refrigerant to a second cooling device that cools a second cooled space, the control program causing the computer to execute an instruction step in response to a start of the frost removing operation, the instruction step comprising issuing an increase instruction to a device control unit configured to control an amount of the refrigerant supplied to the second cooling device, the increase instruction instructing the device control unit to increase the amount of the refrigerant supplied to the second cooling device, to an amount larger than that before the frost removing operation starts.

In the control program according to the present invention, the program may further cause the computer to execute a selection step prior to the instruction step, the selection step comprising selecting the second cooling device as a cooling device having relatively high thermal stability under a condition with a decreased amount of the refrigerant supplied, from a plurality of cooling devices that include the second cooling device and that are configured to respectively cool a plurality of cooled spaces including the second cooled space.

The present invention can provide a control system, an integrated control apparatus, and a control program that can well maintain freshness or quality of food articles by reducing time for performing a recovery operation after a frost removing operation of cooling devices.

BRIEF DESCRIPTION OF THE DRAWINGS

FIG. 6 is a view showing one example of an operation control by a device control unit 43 according to the first embodiment of the present invention.

FIG. 24 is one example of the display appearance in the display unit 15 according to the second embodiment of the present invention.

FIG. 27 is a database configuration diagram of a device information database 145 according to the third embodiment of the present invention.

FIG. 28 is a database configuration diagram of a machine type parameter database 146 according to the third embodiment of the present invention.

FIG. 29 is a database configuration diagram of an article parameter database 147 according to the third embodiment of the present invention.

FIG. 31 is a database configuration diagram showing one example of pull-down time that the integrated control apparatus 10 according to the embodiments of the present invention stores for each showcase.

DESCRIPTION OF THE PREFERRED EMBODIMENTS

First Embodiment (1) Overall Configuration of Control System

First, an overall schematic configuration of a control system according to a first embodiment, specifically, (1.1) Schematic Configuration of Control System, (1.2) Configuration of Refrigerant Circulation Circuit, (1.3) Configuration of Showcases, and (1.4) Schematic Configuration of An Integrated Control Apparatus and Each Control Unit, will be described.

(1.1) Schematic Configuration of Control System

Figure 1:
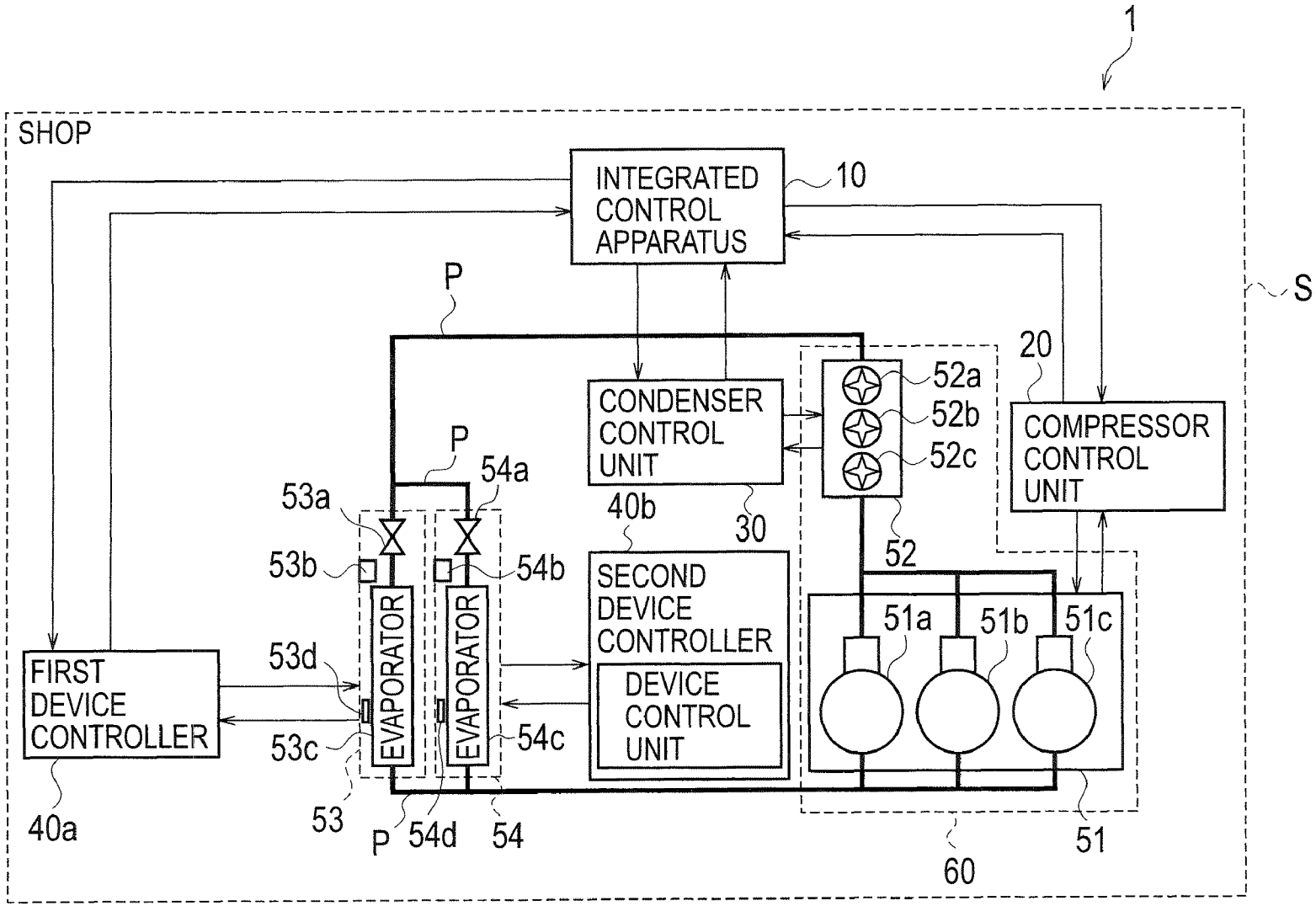
FIG. 1 is an overall schematic configuration diagram of a control system 1 according to a first embodiment of the present invention.

FIG. 1 is an overall schematic configuration diagram of a control system 1 according to the first embodiment.

As shown in FIG. 1, the control system 1 has an integrated control apparatus 10, and is configured to integrally control a first showcase 53 and a second showcase 54 that are cooling devices for cooling a cooled space installed in a shop S such as a supermarket, a convenience store or the like, and used for refrigerating/freezing articles. In each of the first showcase 53 and the second showcase 54, the cooled space refers to the inside of a compartment.

(1.2) Configuration of Refrigerant Circulation Circuit

As shown in FIG. 1, in the shop S, a compressor 51, a condenser 52, the first showcase 53, the second showcase 54, and a refrigerant piping P are installed. The compressor 51, the condenser 52, the first showcase 53, and the second showcase 54 are connected to each other by the refrigerant piping P. In addition, the compressor 51 and the condenser 52 are components that configure a refrigerant supplying device 60 for supplying a refrigerant to the first showcase 53 and the second showcase 54.

The compressor 51 has 3 compressors 51*a* to 51*c* with different compressing forces. The refrigerant compressed by the compressor 51 is guided to the condenser 52 through the refrigerant piping P. The condenser 52 has fans 52*a* to 52*c*, and condenses the refrigerant with use of the fans 52*a* to 52*c*. Guided to the first showcase 53 and the second showcase 54 through the refrigerant piping P, the refrigerant condensed by the condenser 52 expands and vaporizes, and removes heat from the compartments of the first showcase 53 and the second showcase 54 during vaporization. The vaporized refrigerant is guided to the compressor 51 again through the refrigerant piping P. Such circulation of the refrigerant cools down articles accommodated in the compartments of the first showcase 53 and the second showcase 54.

(1.3) Configuration of Showcase

The first showcase 53 includes a solenoid valve 53*a*, a sensor 53*b*, an evaporator 53*c*, and a heater 53*d*. The refrigerant expands in the solenoid valve 53*a*, and the expanded refrigerant vaporizes in the evaporator 53*c*. Now, the solenoid valve 53*a* has a function of adjusting the amount of refrigerant supplied to the first showcase 53, in proportion to the aperture ratio of the valve. The aperture ratio of the solenoid valve 53*a* can be calculated on the basis of a ratio of an opening area to a full opening area, opening time per unit time, or a combination thereof. In addition, as described later, the aperture ratio of the solenoid valve 53*a* is controlled on the basis of a difference between a set temperature and a temperature inside of the compartment of the first showcase 53.

The sensor 53*b* detects the temperature inside of the compartment of the first showcase 53, and an ambient temperature of the first showcase 53, or the like.

The evaporator 53*c* acts as a heat exchanger. Moisture in the air attaches to the evaporator 53*c* as frost. When the frost attaches to the evaporator 53*c*, heat exchange in the evaporator 53*c* is slowed, and the cooling capability degrades. Thus, a frost removing operation, which is an operation mode for removing the frost attached to the evaporator 53*c*, should be regularly performed by closing the solenoid valve 53*a* and heating the evaporator 53*c* by using the heater 53*d*. However, the frost removing operation is not limited to the operation using the heater 53*d*, but may be the operation of just closing the solenoid valve 53*a*.

The frost removing operation is performed till a predetermined termination condition is satisfied after it begins. Such a termination condition is a condition that makes it possible to consider that the frost has been removed, and as criteria for determining the termination condition, at least one of the temperature inside of the compartment, a temperature of the refrigerant, humidity in the compartment, a refrigerant pressure, and time elapsed from the start of the frost removing operation can be used.

When the frost removing operation is performed, a recovery operation (a pull-down operation) for recovering cooling conditions that well maintain freshness and quality of food articles is performed. The recovery operation is an operation mode for lowering the temperature inside of the compartment elevated while the frost removing operation is performed to the set temperature of a cooling operation. When the frost removing operation ends, the recovery operation is started. The recovery operation is performed till the temperature inside of the compartment returns to the set temperature.

The second showcase 54 has a configuration similar to the first showcase 53. Now, when the recovery operation is performed in one of the first showcase 53 and the second showcase 54, the amount of refrigerant supplied to the one showcase increases and the amount of refrigerant supplied to the other showcase decreases. Thus, schedules of the first showcase 53 and the second showcase 54 should be linked with each other so that a time period for performing the frost removing operation does not overlap a time period for performing the recovery operation. In the first embodiment, such scheduling is performed by the integrated control apparatus 10. In other words, the integrated control apparatus 10 controls an operation of the first showcase 53 and an operation of the second showcase 54 in collaboration with each other. In some cases, the first showcase 53 and the second showcase 54 may be requested of fully cooled condition, depending on a time period. The cases in which the fully cooled condition is requested are a time period during which an employee regularly checks the temperature inside of the compartment or a time period during which articles are refilled in the compartment, for example. The integrated control apparatus 10 may perform scheduling in consideration of such cases.

(1.4) Schematic Configuration of An Integrated Control Apparatus and Each Control Unit In the shop S, the integrated control apparatus 10 and various control units are installed. Specifically, in the shop S, as the various control units, a compressor control unit 20 configured to control the compressor 51, a condenser control unit 30 configured to control the condenser 52, a first device controller 40*a* configured to control the first showcase 53, and a second device controller 40*b* configured to control the second showcase 54 are installed.

The integrated control apparatus 10 performs mutual communications with the various control units, integrally manages operation conditions of component devices or the like, and causes the component devices to collaborate with each other. Specifically, through communications with the first device controller 40*a* and the second device controller 40*b*, the integrated control apparatus 10 keeps track of the operation conditions in the first showcase 53 and the second showcase 54, and provides an instruction to start the frost removing operation for the first showcase 53 and the second showcase 54.

In response to instructions of the integrated control apparatus 10, the first device controller 40*a* and the second device controller 40*b* control the amount of the refrigerant supplied to the first showcase 53 and the second showcase 54. Specifically, the device control unit 43 (not shown) included in the first device controller 40*a* controls the solenoid valve 53*a* of the first showcase 53 on the basis of sensor values outputted by the sensor 53*b*, so that the temperature inside of the compartment is the set temperature. That is, the first device controller 40*a* increases the aperture ratio of the solenoid 53*a*, as the temperature inside of the compartment becomes higher than the set temperature, while the first device controller 40*a* decreases the aperture ratio of the solenoid valve 53*a*, as the temperature inside of the compartment becomes lower than the set temperature.

Similarly, the device control unit 43 (refer to FIG. 5) included in the second device controller 40*b* controls the solenoid valve 54*a* of the second showcase 54 on the basis of sensor values outputted by the sensor 54*b*, so that the temperature inside of the compartment is the set temperature. That is, the second controller 40*b* increases the aperture ratio of the solenoid valve 54*a*, as the temperature inside of the compartment becomes higher than the set temperature, while the second controller 40*b* decreases the aperture ratio of the solenoid valve 54*a*, as the temperature inside of the compartment is lower than the set temperature. Although it is common that the first device controller 40*a* and the second device controller 40*b* are respectively provided in a one-to-one relation to the first showcase 53 and the second showcase 54, one device controller may control valves of more than one showcase.

In addition, although the control system 1 according to the first embodiment includes the first device controller 40*a*, the second device controller 40*b*, and the integrated control equipment 10, the first device controller 40*a* and the second device controller 40*b* may be included in the integrated control apparatus 10.

(2) Configuration of an Integrated Control Apparatus and Device Controllers

Configurations of the integrated control apparatus and the device controllers, specifically, (2.1) Configuration of An Integrated Control Apparatus, (2.2) Configurations of First Device Controller and Second Device Controller, and (2.3) Collaboration of First Device Controller and Second Device Controller will be described hereinafter.

(2.1) Configuration of an Integrated Control Apparatus

Figures 2, 3, 4:
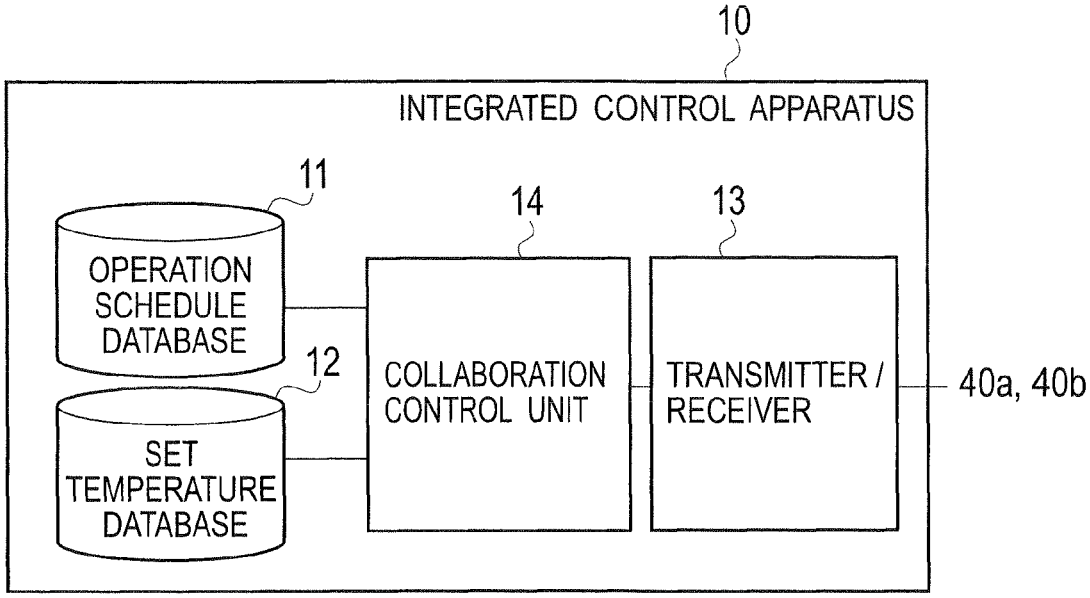
FIG. 2 is a configuration diagram of an integrated control apparatus 10 according to the first embodiment of the present invention.
FIG. 3 is a database configuration diagram of an operation schedule database 11 according to the first embodiment of the present invention.
FIG. 4 is a database configuration diagram of a set temperature database 12 according to the first embodiment of the present invention.

FIG. 2 is a configuration diagram of the integrated control apparatus 10. As shown in FIG. 2, the integrated control apparatus 10 has an operation schedule database 11, a set temperature database 12, a transmitter/receiver 13, and a collaboration control unit 14. Note that parts related to the present invention will be mainly described hereinafter.

FIG. 3 is a database configuration diagram of the operation schedule database 11. In the operation schedule database 11, frost removal start time predetermined for each of the first showcase 53 and the second showcase 54 is stored. As shown in FIG. 3, in the first showcase 53, the frost removal start time is set three times a day from 0 o'clock in the morning at intervals of 8 hours. In addition, in the second showcase 54, the frost removal start time is set three times a day from 4 o'clock in the morning at intervals of 8 hours.

FIG. 4 is a database configuration diagram of the set temperature database 12. In the set temperature database 12, a predetermined standard temperature, an upper limit temperature, and a lower limit temperature for each of the first showcase 53 and the second showcase 54 are stored. The standard temperature $T_{1S}$ is the set temperature during a normal cooling operation of the first showcase 53. The upper limit temperature $T_{1H}$ and the lower limit temperature $T_{1L}$ represent a temperature range in which freshness or quality of articles displayed in the compartment of the first showcase 53 can be maintained. Similarly, the standard temperature $T_{2S}$ is the set temperature during a normal cooling operation of the second showcase 54. The upper limit temperature $T_{2H}$ and the lower limit temperature $T_{2L}$ represent a temperature range in which freshness or quality of articles displayed in the compartment of the second showcase 54 can be maintained.

When the frost removal start time of the first showcase 53 comes, for example, the collaboration control unit 14 not only transmits an "instruction to start frost removal" instructing the first device controller 40*a* to start to perform the frost removing operation, via the transmitter/receiver 13, but also transmits a "lower limit cooling instruction (increase instruction)" instructing the device control unit to increase the amount of the refrigerant supplied to the second showcase 54, to the second device controller 40*b*. In the first embodiment, the "lower limit cooling instruction" includes temperature information indicating the lower limit temperature $T_{2L}$ that is the set temperature for the second showcase 54. If the lower limit temperature $T_{2L}$ is set as the set temperature in the second device controller 40*b*, the second device controller 40*b* increases the aperture ratio of a solenoid valve 54*a* since the temperature inside of the compartment is higher than the set temperature. This increases the amount of the refrigerant supplied to the second showcase 54.

In addition, when the collaboration control unit 14 acquires a "frost removal end notice" indicating that an execution of the frost removing operation ends, from the first device controller 40*a* via the transmitter/receiver 13, the collaboration control unit 14 transmits an "upper limit cooling instruction (decrease instruction)" instructing the device control unit 43 to decrease the amount of the refrigerant supplied to the second showcase 54, to the second device controller 40*b* via the transmitter/receiver 13. In the first embodiment, the "upper limit cooling instruction" includes temperature information indicating the upper limit temperature $T_{2H}$ that is the set temperature of the second showcase 54. If the upper limit temperature $T_{2H}$ is set as the set temperature in the second device controller 40*b*, the second device controller 40*b* decreases the aperture ratio of the solenoid valve 54*a* since the temperature inside of the compartment is lower than the set temperature. This decreases the amount of the refrigerant supplied to the second showcase 54.

In addition, when the collaboration control unit 14 acquires a "recovery end notice" indicating that an execution of the recovery operation ends, from the first device controller 40*a* via the transmitter/receiver 13, the collaboration control unit 14 transmits a "standard cooling instruction" instructing the second device controller 40*b* to perform the cooling operation at the standard temperature $T_{2S}$ via the transmitter/receiver 13. The "standard cooling instruction" includes temperature information indicating the standard temperature $T_{2S}$ that is the set temperature of the second showcase 54. If the standard temperature $T_{2S}$ is set as the set temperature in the second device controller 40*b*, the second device controller 40*b* increases the aperture ratio of the solenoid valve 54*a* since the temperature inside of the compartment is higher than the set temperature.

(2.2) Configurations of First Device Controller and Second Device Controller

Figure 5:
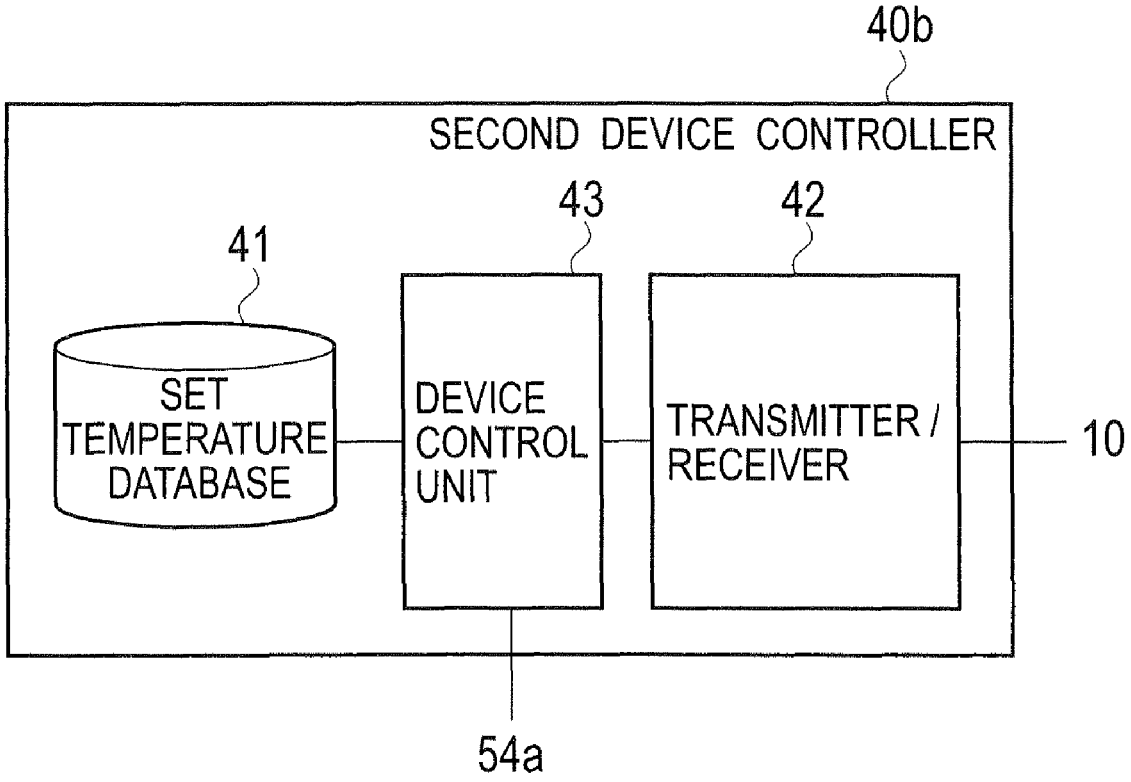
FIG. 5 is a configuration diagram of a second device controller 40*b* according to the first embodiment of the present invention.

FIG. 5 is a configuration diagram of the second device controller 40*b*. As shown in FIG. 5, the second device controller 40*b* has a set temperature database 41, a transmitter/receiver 42, and a device control unit 43. The second device controller 40*b* will be described hereinafter. In addition, the first device controller 40*a* and the second device controller 40*b* have similar configurations.

In the set temperature database 41, the standard temperature $T_{2S}$, the upper limit temperature $T_{2H}$, and the lower limit temperature $T_{2L}$ that are predetermined for the second showcase 54 are stored (See FIG. 4).

The transmitter/receiver 42 transmits each notice from the device control unit 43 to the integrated control apparatus 10 (collaboration control unit 14), and receives each instruction from the integrated control apparatus 10 (collaboration control unit 14).

The device control unit 43 controls operations of the second showcase 54. Specifically, the device control unit 43 performs the cooling operation, which is an operation mode for cooling the inside of the compartment, the frost removing operation, which is an operation mode for removing frost attached to the evaporator 54*c*, and the recovery operation, which is an operation mode for recovery from the frost removing operation to the cooling operation.

The device control unit 43 usually performs the cooling operation in which the set temperature is the standard temperature $T_{2S}$ (hereinafter referred to as a "standard cooling operation"). On the other hand, when acquiring a "lower limit cooling instruction", the device control unit 43 performs the cooling operation in which the set temperature is the lower limit temperature $T_{2L}$ (hereinafter referred to as a "lower limit cooling operation"). In addition, when acquiring an "upper limit cooling instruction", the device control unit 43 performs the cooling operation in which the set temperature is the upper limit temperature $T_{2H}$ (hereinafter referred to as an "upper limit cooling operation"). In addition, when acquiring the "standard cooling instruction", the device control unit 43 performs the standard cooling operation in which the set temperature is the standard temperature $T_{2S}$. In this way, the device control unit 43 according to the first embodiment performs three types of cooling operation with the different set temperatures.

(2.3) Collaboration Control of First Device Controller and Second Device Controller One example of collaboration control of the first device controller 40*a* and the second device controller 40*b* will be described hereinafter with reference to the drawings. FIG. 6 is a view showing one example of collaboration control of the first device controller 40*a* and the second device controller 40*b*.

As shown in FIG. 6, the device control unit 43 of the first device controller 40*a* starts to perform the frost removing operation at 0:00 and finishes performing the frost removing operation at 0:30. In addition, the device control unit 43 of the first device controller 40*a* starts to perform the recovery operation at 0:30 and finishes performing the recovery operation at 0:45. The device control unit 43 of the first device controller 40*a* transmits an "instruction to start frost removal" at 0:00, a "frost removal end notice" at 0:30, and further a "recovery end notice" at 0:45, to the integrated control apparatus 10 (collaboration control unit 14).

On the other hand, the device control unit 43 of the second device controller 40*b* starts to perform a lower limit cooling operation at 0:00, and finishes performing the lower limit cooling operation at 0:30. In addition, the device control unit 43 of the second device controller 40*b* starts to perform an upper limit cooling operation at 0:30, and finishes performing the upper limit cooling operation at 0:45. The device control unit 43 of the second device controller 40*b* receives a "lower limit cooling instruction" at 0:00, an "upper limit cooling instruction" at 0:30, and further a "normal cooling instruction" at 0:45 from the integrated control apparatus 10 (collaboration control unit 14).

In this way, the first device controller 40*a* and the second device controller 40*b* are collaboratively controlled by the integrated control apparatus 10 (collaboration control unit 14). Specifically, an execution of the frost removing operation by the first device controller 40*a* and an execution of the lower limit cooling operation by the second device controller 40*b* are caused to collaborate with each other. In addition, an execution of the recovery operation by the first device controller 40*a* and an execution of the upper limit cooling operation by the second device controller 40*b* are caused to collaborate with each other.

(3) Operations of an Integrated Control Apparatus and Device Controller

Operations of the integrated control apparatus 10 and the device controller, specifically, (3.1) Operation of An Integrated Control apparatus, and (3.2) Operation of First Device Controller and Second Device Controller, will be described hereinafter.

(3.1) Operation of an Integrated Control Apparatus

Figure 7:
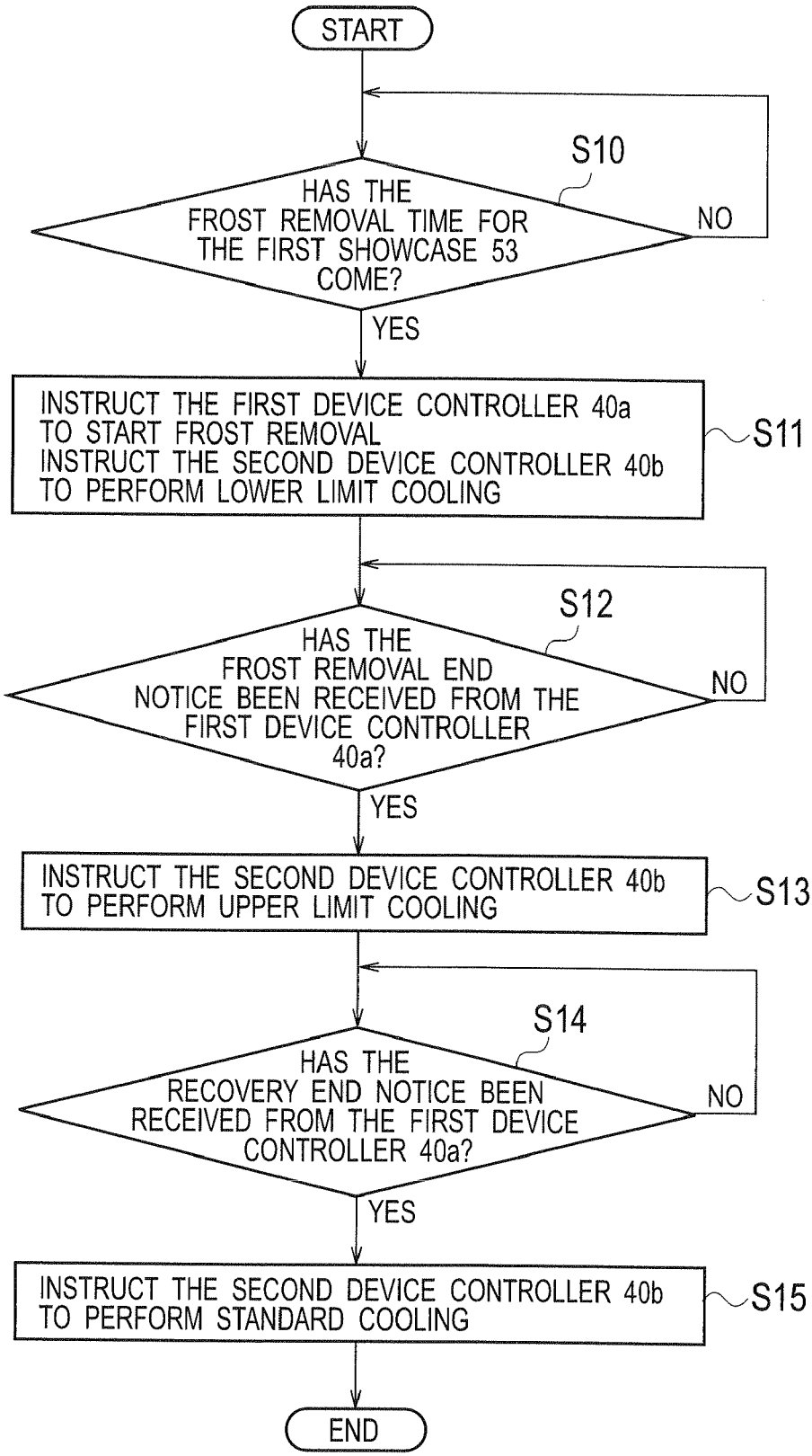
FIG. 7 is a flow chart showing an operation of the integrated control apparatus 10 according to the first embodiment of the present invention.

FIG. 7 is a flow chart showing operation of the integrated control apparatus 10. In addition, FIG. 7 shows a case in which the frost removing operation of the first showcase 53 is performed.

In step S10, the integrated control apparatus 10 determines whether or not frost removal start time of the first showcase 53 has come. If the frost removal start time has come, the integrated control apparatus 10 proceeds to the process of step S11. In contrast, if the frost removal start time has not come, the integrated control apparatus 10 performs the step S10 repeatedly.

In step S11, the integrated control apparatus 10 not only transmits an "instruction to start frost removal" to the first device controller 40*a* (device control unit 43) but also transmits a "lower limit cooling instruction" to the second device controller 40*b* (device control unit 43).

In step S12, the integrated control apparatus 10 determines whether or not it has received a "frost removal end notice" from the first device controller 40*a* (device control unit 43). If the integrated control apparatus 10 has received the "frost removal end notice", it proceeds to the process of step S13. On the other hand, if the integrated control apparatus 10 has not received the "frost removal end notice", it repeatedly performs step S12.

In step S13, the integrated control apparatus 10 transmits an "upper limit cooling instruction" to the second device controller 40*b* (device control unit 43).

In step S14, the integrated control apparatus 10 determines whether or not it has received a "recovery end notice" from the first device controller 40*a* (device control unit 43). If the integrated control apparatus 10 has received the "recovery end notice", it proceeds to the process of step S15. In contrast, if the integrated control apparatus 10 has not received the "recovery end notice", it repeats step S14.

In step S15, the integrated control apparatus 10 transmits a "standard cooling instruction" to the second device controller 40*b* (device control unit 43).

(3.2) Operations of First Device Controller and Second Device Controller

Figure 8:
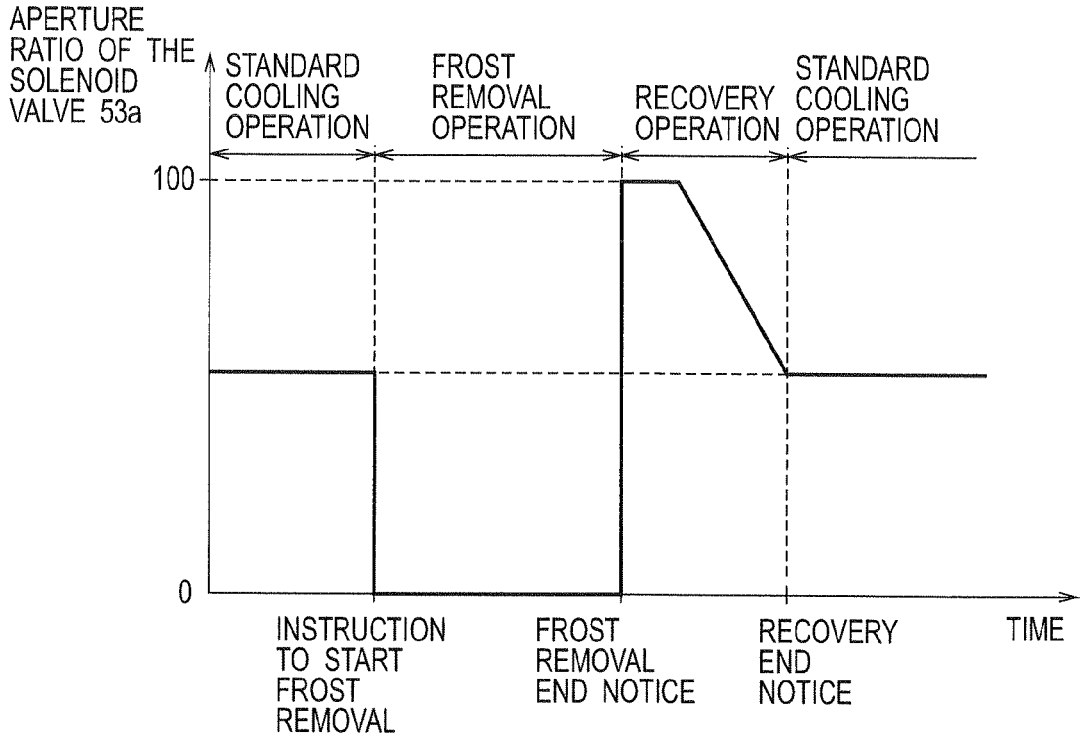
FIG. 8 is a view for illustrating an operation of a first device controller 40*a* according to the first embodiment of the present invention.
Figure 9:
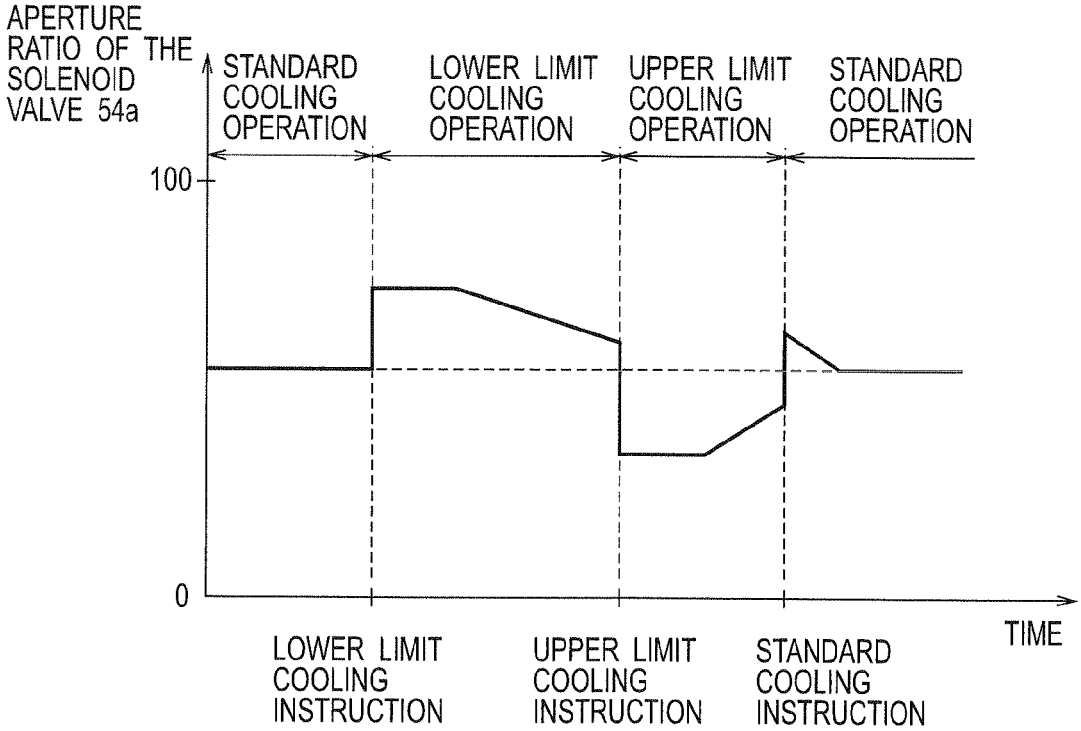
FIG. 9 is a view for illustrating an operation of the second device controller 40*b* according to the first embodiment of the present invention.

One example of the operations of the first device controller 40*a* and the second device controller 40*b* will be described hereinafter with reference to the drawings. FIG. 8 is a view for illustrating an operation of the first device controller 40*a* (device control unit 43) FIG. 9 is a view for illustrating an operation of the second device controller 40*b* (device control unit 43).

As shown in FIG. 8, the first device controller 40*a* causes the first showcase 53 to perform a standard cooling operation by setting the set temperature to the standard temperature $T_{1S}$ till the first device controller 40*a* acquires the "instruction to start frost removal". If the first device controller 40*a* has received the "instruction to start frost removal", it controls the aperture ratio of the solenoid valve 53*a* to "0", that is, controls the solenoid valve 53*a* to fully closed, by removing the set temperature. With this, the first device controller 40*a* causes the first showcase 53 to perform the frost removing operation.

Next, if the first device controller 40*a* has detected end of the frost removal, it not only transmits a "frost removal end notice" to the integrated control apparatus 10, but also increases the aperture ratio of the solenoid valve 53*a* to "100", that is, changes the solenoid valve 53*a* to fully open, by setting the set temperature to the standard temperature $T_{1S}$. With this, the first device controller 40*a* causes the first showcase 53 to perform the recovery operation.

Then, when the temperature inside of the compartment has reached the standard temperature $T_{1S}$, the first device controller 40*a* transmits a "recovery end notice" to the integrated control apparatus 10. In addition, since the first device controller 40*a* controls the aperture ratio of the solenoid valve 53*a*, depending on a difference between the temperature inside of the compartment and the standard temperature $T_{1S}$, the aperture ratio of the solenoid valve 53*a* will gradually decrease.

On the other hand, as shown in FIG. 9, till the second device controller 40*b* acquires a "lower limit cooling instruction", it causes the second showcase 54 to perform the standard cooling operation by setting the set temperature to the standard temperature $T_{2S}$. When the second device controller 40*b* acquires the "lower limit cooling instruction", it increases the aperture ratio of the solenoid valve 54*a* by setting the set temperature to the lower limit temperature $T_{2L}$. With this, the second device controller 40*b* causes the second showcase 54 to perform the lower limit cooling operation.

Next, when the second device controller 40*b* acquires an "upper limit cooling instruction", it decreases the aperture ratio of the solenoid valve 54*a* by setting the set temperature to the upper limit temperature $T_{2H}$. With this, the second device controller 40*b* causes the second showcase 54 to perform the upper limit cooling operation.

Then, when the second device controller 40*b* acquires a "standard cooling instruction", it increases the aperture ratio of the solenoid valve 54*a* by setting the set temperature to the standard temperature $T_{2S}$. With this, the second device controller 40*b* causes the second showcase 54 to perform the standard cooling operation.

As described above, the operation of the first showcase 53 and the operation of the second showcase 54 are caused to collaborate with each other by the integrated control apparatus 10. Specifically, as shown in FIG. 8 and 9, the frost removing operation of the first showcase 53 and the lower limit cooling operation of the second showcase 54 are caused to collaborate with each other, and the recovery operation of the first showcase 53 and the upper limit cooling operation of the second showcase 54 are caused to collaborate with each other.

Figure 10:
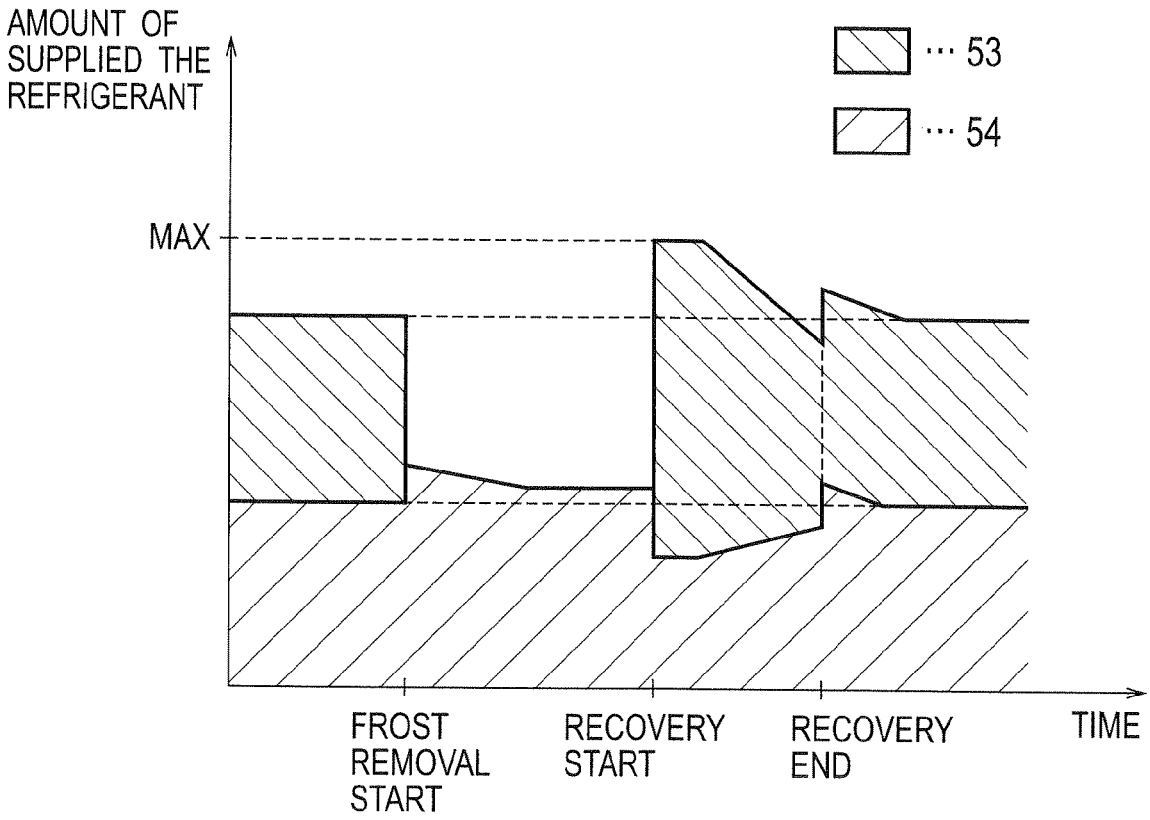
FIG. 10 is a graph showing a transition of the amount of a refrigerant supplied from a refrigerant supplying device 60 according to the first embodiment of the present invention.

FIG. 10 is a graph showing a transition of the amount of the refrigerant supplied to the first showcase 53 and the second showcase 54 from a refrigerant supplying device 60. As shown in FIG. 10, while the first showcase 53 is performing the frost removing operation, the amount of the refrigerant supplied to the second showcase 54 increases. In contrast, while the first showcase 53 is performing the recovery operation, the amount of the refrigerant supplied to the second showcase 54 decreases, and the amount of the refrigerant supplied to the first showcase 53 increases. In addition, as shown in FIG. 10, after the recovery operation of the first showcase 53 ends, the amount of the refrigerant supplied to the second showcase 54 temporarily increases. This is because a difference between the temperature inside of the compartment and the set temperature increases as a result of the set temperature of the second showcase 54 being switched from the upper limit temperature $T_{2H}$ to the standard temperature $T_{2S}$.

Figure 11:
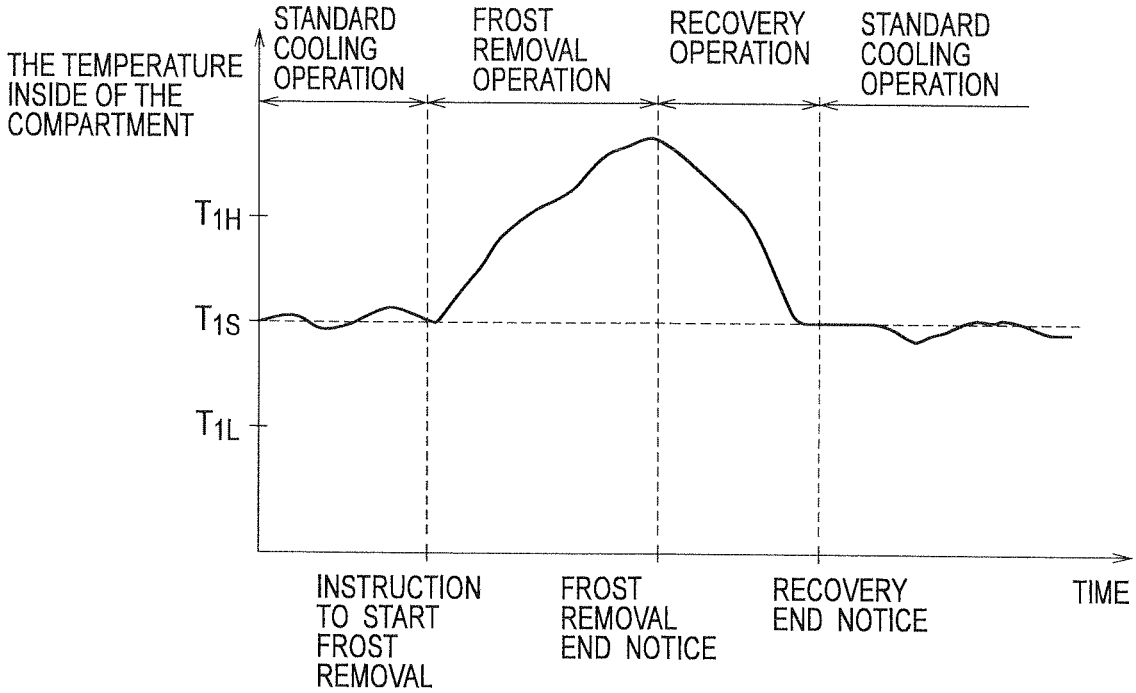
FIG. 11 is a graph showing a transition of a temperature inside of a compartment of a first showcase 53 according to the first embodiment of the present invention.
Figure 12:
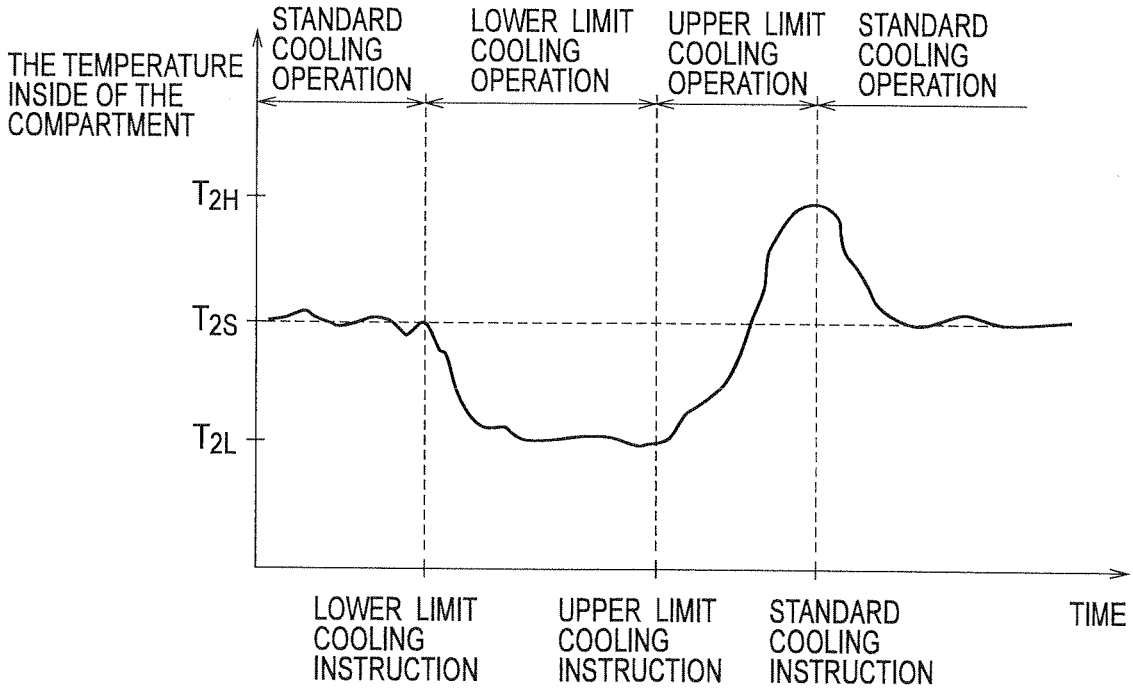
FIG. 12 is a graph showing a transition of a temperature inside of a compartment of a second showcase 54 according to the first embodiment of the present invention.

Transitions in the temperature inside of the compartment of the first showcase 53 and the second showcase 54 will be described hereinafter. FIG. 11 is a graph showing a transition of the temperature inside of the compartment of the first showcase 53. FIG. 12 is a graph showing a transition of the temperature inside of the compartment of the second showcase 54.

As shown in FIG. 11, the temperature inside of the compartment of the first showcase 53 gradually rises from the standard temperature $T_{1S}$, when the first showcase 53 is caused to perform the frost removing operation by removing the set temperature. Then, the temperature inside of the compartment of the first showcase 53 decreases to the standard temperature $T_{1S}$, when the first showcase 53 is caused to perform the recovery operation by changing the set temperature to the standard temperature $T_{1S}$.

In contrast, as shown in FIG. 12, the temperature inside of the compartment of the second showcase 54 gradually decreases from the standard temperature $T_{2S}$ to the lower limit temperature $T_{2L}$, when the second showcase 54 is caused to perform the lower limit cooling operation by setting the set temperature to the lower limit temperature $T_{2L}$. Then, the temperature inside of the compartment of the second showcase 54 gradually increases toward the upper temperature $T_{2H}$, when the second showcase 54 is caused to perform the upper limit cooling operation by setting the set temperature to the upper limit temperature $T_{2H}$. After that, the temperature inside of the compartment of the second showcase 54 gradually decreases towards the standard temperature $T_{2S}$ when the second showcase 54 is caused to perform the standard cooling operation by setting the set temperature to the standard temperature $T_{2S}$.

(4) Advantageous Effect

In response to a start of the frost removing operation of the first showcase 53, the integrated control apparatus 10 according to the first embodiment provides the second device controller 40*b* (device control unit 43) with a "lower limit cooling instruction (increase instruction)" instructing the device control unit 43 to increase the refrigerant supplied to the second showcase 54, to an amount larger than that before the frost removing operation starts. The second device controller 40*b* (device control unit 43) increases the amount of the refrigerant supplied to the second showcase 54, according to the "lower limit cooling instruction (increase instruction)".

In response to the start of the frost removing operation of the first showcase 53, the second device controller 40*b* (device control unit 43) increases the amount of the refrigerant supplied to the second showcase 54. That is, after the frost removing operation of the first showcase 53 starts, the inside of the compartment of the second showcase 54 is cooled down to a low temperature (lower limit temperature $T_{2L}$) below normal cooling condition. Thus, after that, even if the amount of the refrigerant supplied to the second 54 is decreased, excessive elevation of the temperature inside of the compartment of the second showcase 54 can be controlled. Consequently, after the frost removing operation of the first showcase 53 ends, by decreasing the amount of the refrigerant supplied to the second showcase 54 and by increasing the amount of the refrigerant supplied to the first showcase 53, the inside of the compartment of the first showcase 53 can be recovered to the normal cooling condition in a small amount of time, while the inside of the compartment of the second showcase 54 is kept in good cooling condition. Thus, freshness or quality of articles displayed in the first showcase 53 and the second showcase 54 can be maintained.

In addition, in response to an end of the frost removing operation of the first showcase 53, the integrated control apparatus 10 according to the first embodiment provides the second device controller 40*b* (device control unit 43) with an "upper limit cooling instruction (decrease instruction)" instructing the device control unit 43 to decrease the refrigerant supplied to the second showcase 54. The second device controller 40*b* (device control unit 43) decreases the amount of the refrigerant supplied to the second showcase 54 according to the "upper limit cooling instruction (decrease instruction)".

Thus, after the frost removing operation of the first showcase 53 ends, by decreasing the amount of the refrigerant supplied to the second showcase 54 and by increasing the amount of the refrigerant supplied to the first showcase 53, the inside of the first showcase 53 can be recovered to the normal cooling condition in a small amount of time.

[Modification of First Embodiment]

A modification of the first embodiment of the present invention will be described hereinafter with reference to the drawings. In the following, differences from the first embodiment described above will be mainly described.

Figure 13:
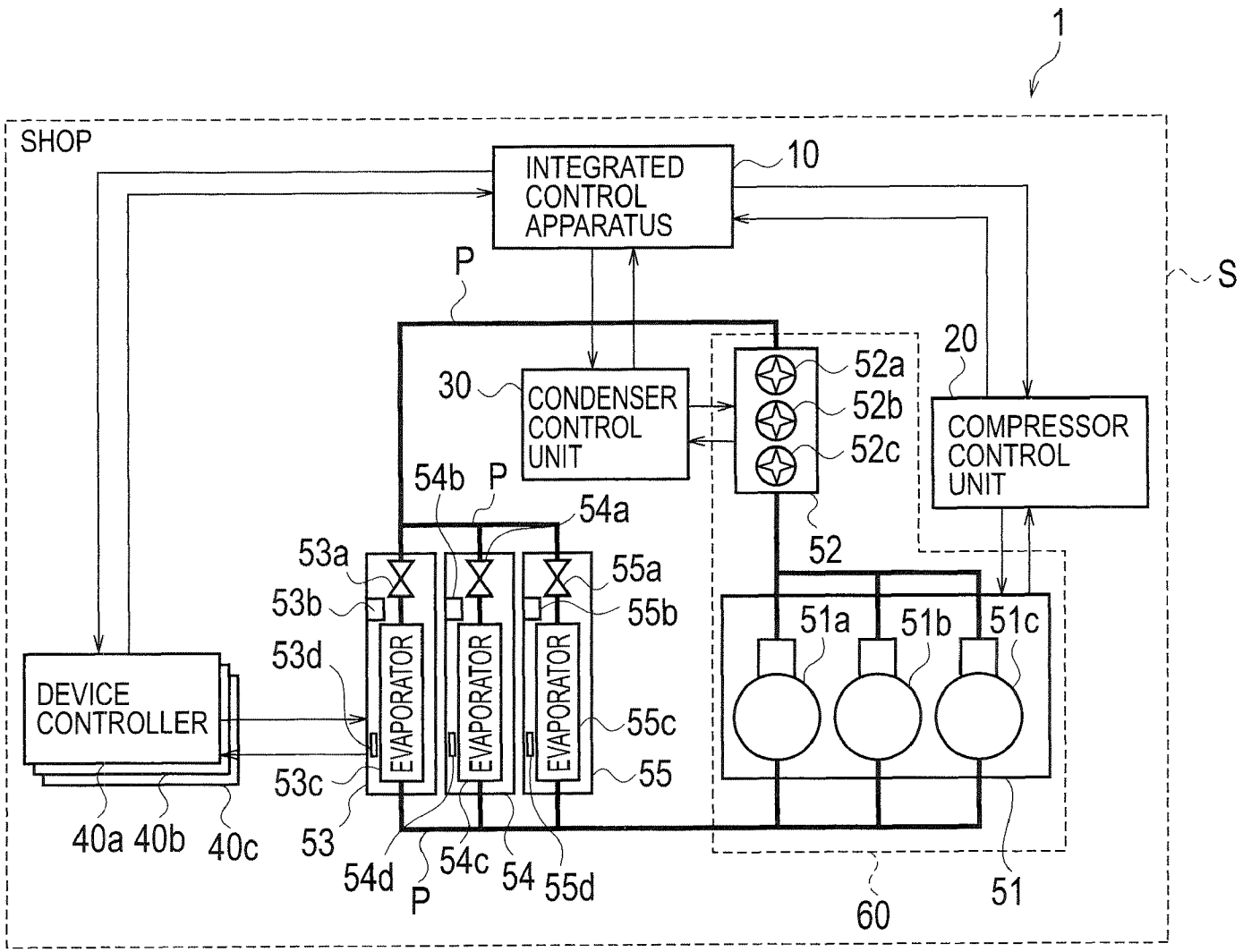
FIG. 13 is an overall schematic configuration diagram of the control system 1 according to a modification of the first embodiment of the present invention.

FIG. 13 is an overall schematic configuration diagram of a control system 1 according to the modification.

As shown in FIG. 13, the control system 1 integrally controls a third showcase 55, in addition to the first showcase 53 and the second showcase 54. In addition, in the modification, the first showcase 53 is a "first cooling device" according to the present invention, the second showcase 54 is a "second cooling device" according to the present invention, and the third showcase 55 is a "third cooling device" according to the present invention.

The third showcase 55 is connected to each of a compressor 51, a condenser 52, the first showcase 53, and the second showcase 54 by the refrigerant piping P. The third showcase 55 has a configuration similar to the first showcase 53.

A third device controller 40*c* controls the amount of the refrigerant supplied to the third showcase 55, according to instructions of the integrated control apparatus 10. The third device controller 40*c* controls a solenoid valve 55*a* of the third showcase 55 so that the temperature inside of the compartment that the sensor 54*b* outputs is the set temperature.

In addition, the integrated control apparatus 10 can update a memory unit every time a frost removing operation of one showcase is performed. Specifically, when the integrated control apparatus 10 notifies the third showcase 55 of the upper limit cooling instruction during a pull-down operation following the frost removing operation of the first showcase 53, the integrated control apparatus 10 uses the third showcase 55, in addition to the second showcase 54, as a showcase (that is, the "second cooling device" according to the present invention) to which an upper limit cooling instruction and a lower limit cooling instruction are given when the frost removing operation of the showcase 53 is performed next time.

(2) Operation of an Integrated Control Apparatus

Figure 14:
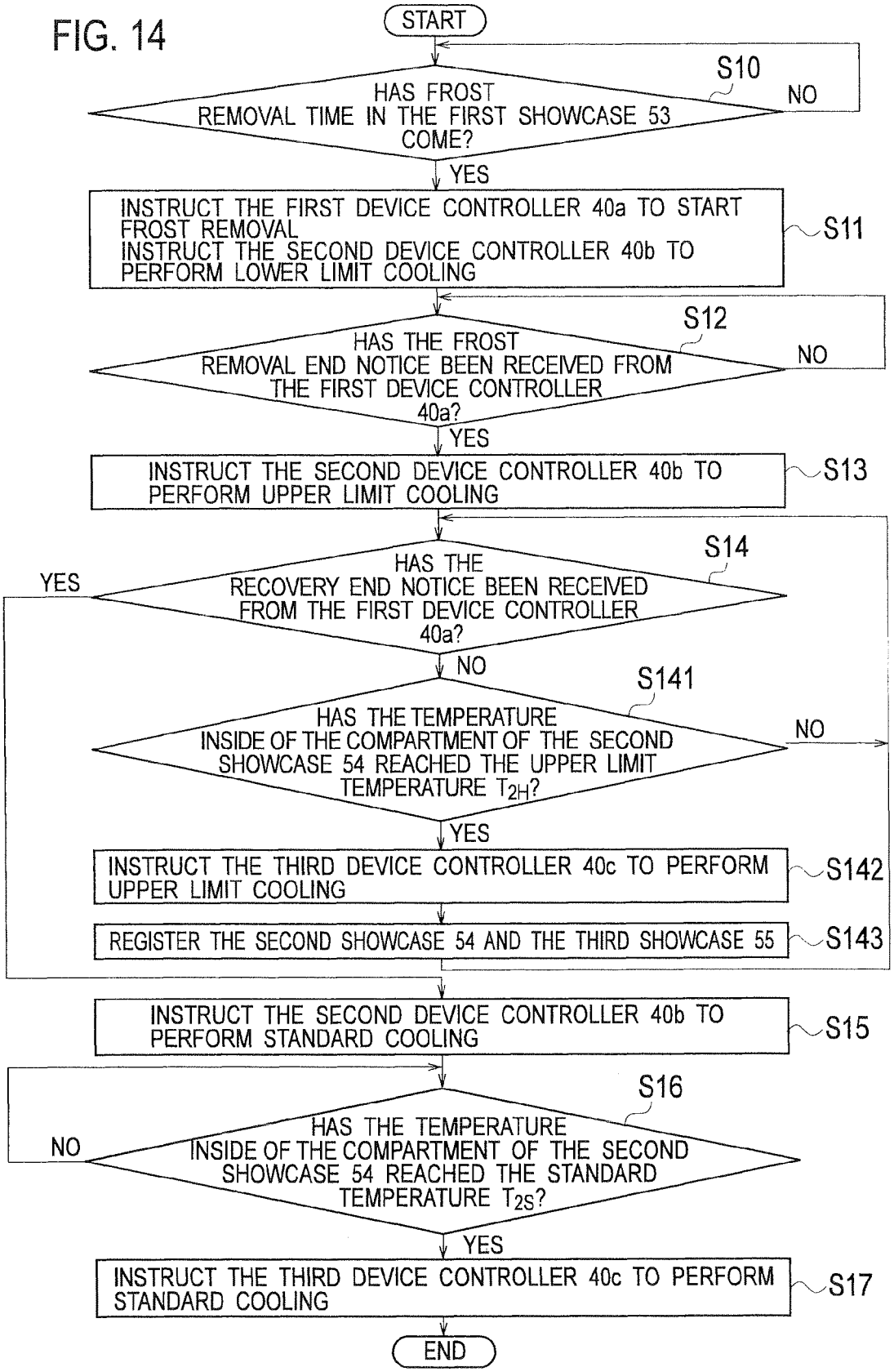
FIG. 14 is a flow chart showing an operation of the integrated control apparatus 10 according to the modification of the present invention.

FIG. 14 is a flow chart showing the operation of the integrated control apparatus 10. Note that FIG. 14 shows a case in which the frost removing operation of the first showcase 53 is performed. In addition, since step S10 to step S14 of FIG. 14 are same as step S10 to step S14 of FIG. 7, steps after S141 will be described in the following.

If in step S14, if the integrated control apparatus 10 has not received a "recovery end notice", the integrated control apparatus 10 determines in step S141 whether or not the temperature inside of the compartment of the second showcase 54 has reached the upper limit temperature $T_{2H}$. If it has reached the upper limit temperature $T_{2H}$, the integrated control apparatus 10 proceeds to the process of step S142. In contrast, if it has not reached the upper limit temperature $T_{2H}$, the integrated control apparatus 10 returns to step S14.

In step S142, the integrated control apparatus 10 transmits an "upper limit cooling instruction" to the third device controller 40*c*.

In step S143, in addition to the second showcase 54, the integrated control apparatus 10 additionally registers the third showcase 55 as the showcase to which the upper limit cooling instruction and the lower limit cooling instruction are given when the frost removing operation of the first showcase 53 is performed next time. After step S143, the process returns to step S14.

If the integrated control apparatus 10 has received a "recovery end notice" in step S14, the integrated control apparatus 10 transmits a "standard cooling instruction" to the second device controller 40*b* in step S15.

In step S16, the integrated control apparatus 10 determines whether or not the temperature inside of the compartment of the second showcase 54 has reached the standard temperature $T_{2S}$. If it has reached the standard temperature $T_{2S}$, the integrated control apparatus 10 proceeds to the process of step S17. In contrast, if it has not reached the standard temperature $T_{2S}$, the integrated control apparatus 10 repeatedly performs step S16.

In step S17, the integrated control apparatus 10 transmits the "standard cooling instruction" to the third device controller 40*c*.

(3) Transition of Temperatures in the Second Showcase and Third Showcase

Figure 15:
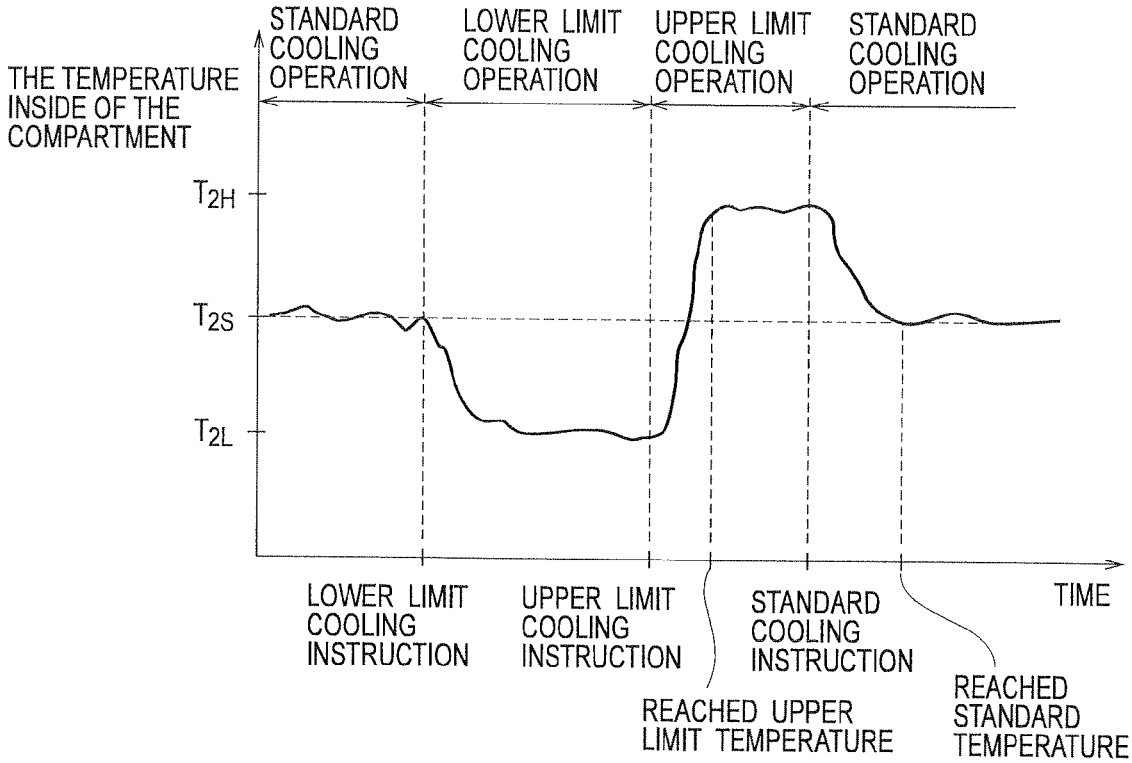
FIG. 15 is a graph showing a transition of the temperature inside of the compartment of the second showcase 54 according to the modification of the first embodiment of the present invention.
Figure 16:
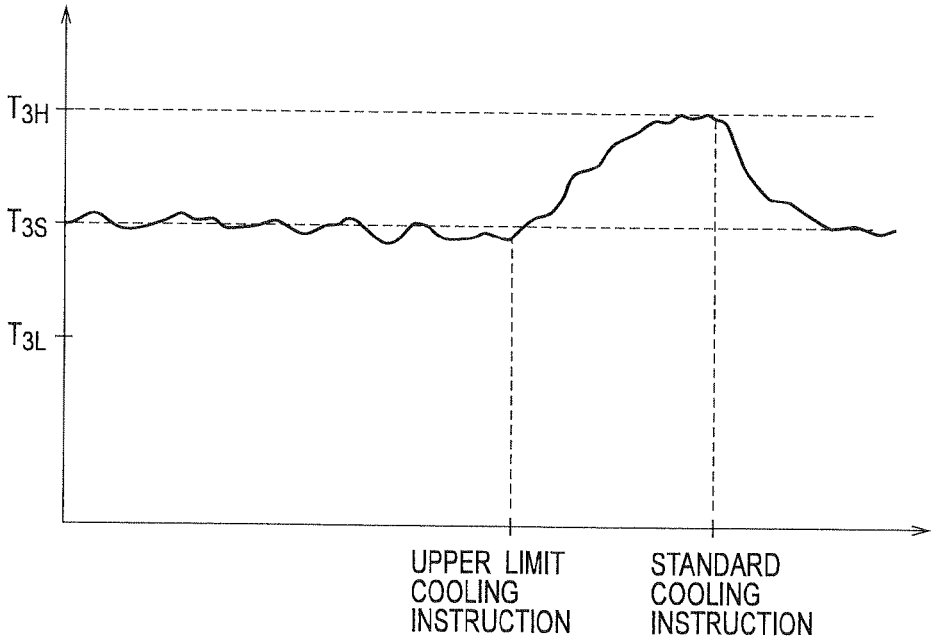
FIG. 16 is a graph showing a transition of a temperature inside of a compartment of a third showcase 55 according to the modification of the first embodiment of the present invention.

FIG. 15 is a graph showing a transition of the temperature inside of the compartment of the second showcase 54. FIG. 16 is a graph showing a transition of the temperature inside of the compartment of the third showcase 55.

As shown in FIG. 15, the temperature inside of the compartment of the second showcase 54 increases towards the upper limit temperature $T_{2H}$ if the second showcase 54 is caused to perform the upper limit cooling operation, by setting the set temperature to the upper limit temperature $T_{2H}$. Now it should be noted that in the modification, the temperature inside of the compartment of the second showcase 54 has reached the upper limit temperature $T_{2H}$ before the standard cooling instruction is received.

After that, the temperature inside of the compartment of the second showcase 54 is maintained at the upper limit temperature $T_{2H}$, and then falls to the standard temperature $T_{2S}$, following the standard cooling instruction.

On the other hand, as shown in FIG. 16, the temperature inside of the compartment of the third showcase 55 is maintained at the standard temperature $T_{2H}$, and then rises toward the upper limit temperature $T_{3H}$, following the upper limit instruction.

Next, the temperature inside of the compartment of the third showcase 55 reaches the upper limit temperature $T_{3H}$, and then is maintained at the upper limit temperature $T_{3H}$.

Next, the temperature inside of the compartment of the third showcase 55 falls to the standard temperature $T_{3S}$, following the standard cooling instruction.

(4) Advantageous Effect

In the modification of the first embodiment, when the temperature inside of the compartment of the second showcase 54 reaches the upper limit temperature during the pull-down operation of the first showcase 53, the integrated control apparatus 10 sets the temperature inside of the compartment of the third showcase 55 to the upper limit temperature.

Thus, the amount of the refrigerant supplied to the first showcase 53 can be increased by reducing the amount of the refrigerant supplied to the third showcase 55. Consequently, the inside of the compartment of the first showcase 53 can be recovered to normal cooling condition in a small amount of time while maintaining the inside of the compartment of the third showcase 55 in good cooling condition. Hence, freshness or quality of articles displayed in the first showcase 53, the second showcase 54 and the third showcase 55 can be maintained.

In addition, in the modification, the integrated control apparatus 10 transmits a "standard cooling instruction" to the third device controller 40*c* after the temperature inside of the compartment of the second showcase 54 has reached the standard temperature $T_{2S}$.

In this way, after the temperature inside of the compartment of the second showcase 54 reaches the standard temperature $T_{2S}$, the temperature inside of the compartment of the third showcase 55 is set to the standard temperature $T_{3S}$. Thus, a large amount of the refrigerant can be prevented from being simultaneously supplied to the second showcase 54 and the third showcase 55, respectively. Consequently, heavy load of supplying the refrigerant put rapidly on the entire control system 1 can be prevented.

In addition, in the modification, the integrated control apparatus 10 uses the third showcase 55, in addition to the second showcase 54, as the showcase to which the upper limit cooling instruction and the lower limit cooling instruction are given when the next frost removing operation of the first showcase 53 is performed. Thus, next time the frost removing operation of the first showcase 53 is performed, the lower limit cooling instruction and the upper limit cooling instruction will be given to the second showcase 54 and the third showcase 55. Consequently, the pull-down operation of the first showcase 53 can be completed promptly.

Second Embodiment

A second embodiment of the present invention will be described hereinafter with reference to the drawings. In the following, differences from the first embodiment described above will be mainly described. In the description of the drawings in the second embodiment to be described hereinafter, the same or similar symbol is assigned to the same or similar part.

(1) Overall Configuration of Control System

An overall schematic configuration of a control system 1 according to the second embodiment is similar to the overall schematic configuration of the control system 1 according to the modification of the first embodiment described above. In the following, a description will be given by using FIG. 13.

In the second embodiment, each of a first device controller 40*a*, a second device controller 40*b*, and a third device controller 40*c* transmits the set temperature of each showcase, the temperature inside of the compartment of each showcases 53 to 55 outputted from each sensors 53*b* to 55*b*, and the ambient temperature to an integrated control apparatus 10. In addition, configurations of the device controllers, collaboration among the device controllers, and the operations of the device controllers are similar to the first embodiment described above (See FIG. 5, 6, 8, and 9).

(2) Configuration of an Integrated Control Apparatus

A configuration of the integrated control apparatus 10 will be described hereinafter.

Figures 17, 18, 19:
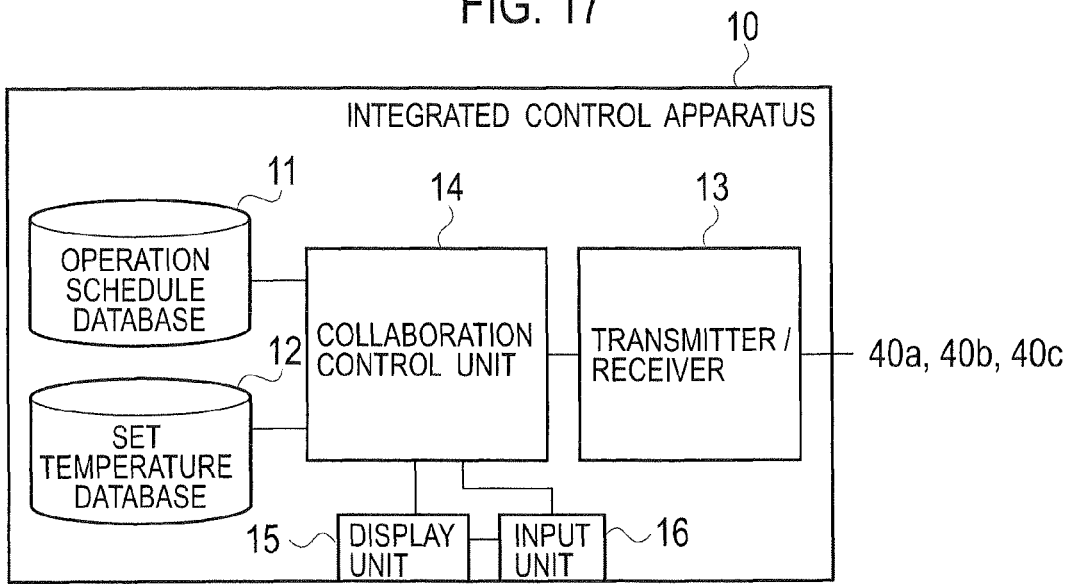
FIG. 17 is a configuration diagram of an integrated control apparatus 10 of a second embodiment of the present invention.
FIG. 18 is a database configuration diagram of an operation schedule database 11 according to the second embodiment of the present invention.
FIG. 19 is a database configuration diagram of a set temperature database of the second embodiment of the present invention.

FIG. 17 is a configuration diagram of the integrated control apparatus 10. As shown in FIG. 17, the integrated control apparatus 10 has a display unit 15 and an input unit 16, in addition to the operation schedule database 11, the set temperature database 12, the transmitter/receiver 13, and the collaboration control unit 14.

FIG. 18 is a database configuration diagram of the operation schedule database 11. As shown in FIG. 18, in the operation schedule database 11, the frost removal start time preset for each of the first showcase 53, the second showcase 54, and the third showcase 55 is stored. The frost removal start time is set three times a day for each of the first showcase 53, the second showcase 54, and the third showcase 55.

In addition, in the embodiment, the first showcase is a "first cooling device" according to the present invention, and a "second cooling device" according to the present invention is to be selected from the second showcase 54 and the third showcase 55.

FIG. 19 is a database configuration diagram of the set temperature database 12. In the set temperature database 12, the set temperature preset for each of the first showcase 53, the second showcase 54, and the third showcase 55 is stored.

In addition, in the second embodiment, as described later, articles displayed in the compartment of the first showcase 53 are dairy products. Articles displayed in the compartment of the second showcase 54 are frozen food. Articles displayed in the third showcase 55 are vegetables. Hence, in the second embodiment, a relation of $T_{2S}<T_{1S}<T_{3S}$ is formed for the standard temperature, a relation of $T_{2H}<T_{1H}<T_{3H}$ is formed for the upper limit temperature, and a relation of $T_{2L}<T_{1L}<T_{3L}$ is formed for the lower limit temperature. In addition, for a difference between the upper limit temperature and the lower limit temperature (hereinafter referred to as "temperature management width"), a relation of $(T_{2H}-T_{2L})>(T_{1H}-T_{1L})>(T_{3H}-T_{3L})$ is formed. That is, the temperature management width of frozen food is the largest, while the temperature management width of vegetables is the smallest.

Figures 20, 21:
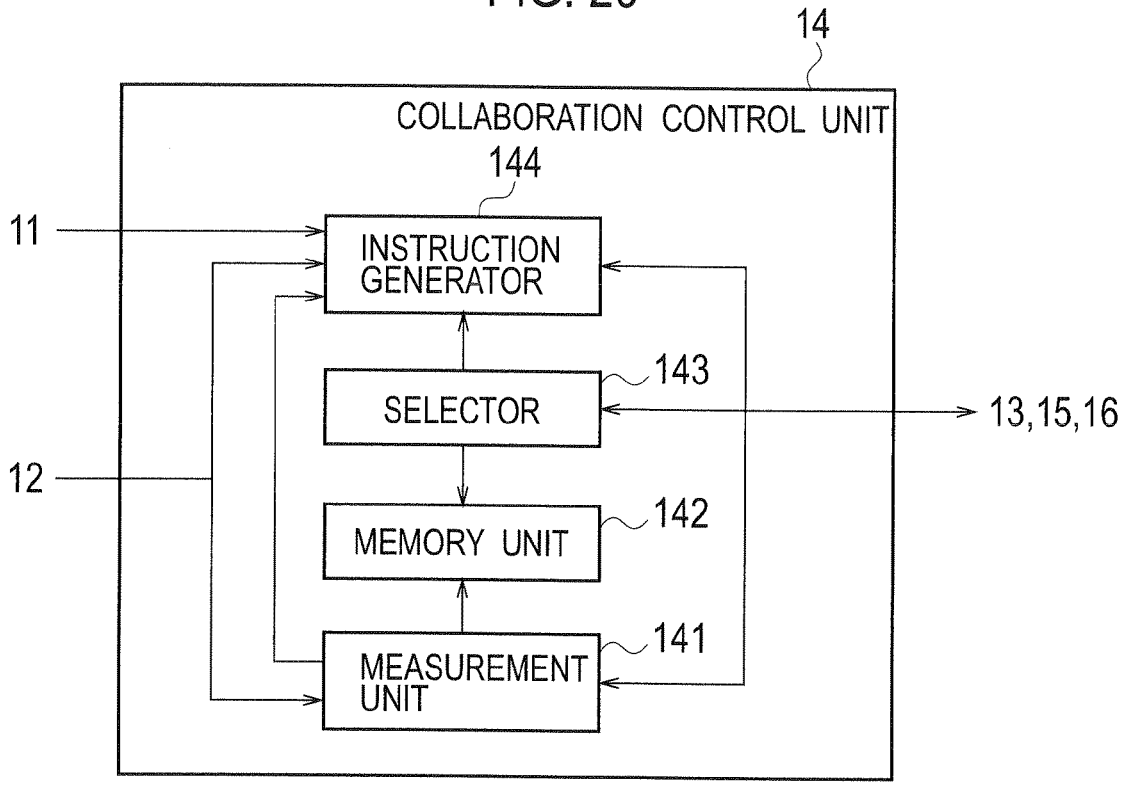
FIG. 20 is a configuration diagram of a collaboration control unit 14 according to the second embodiment of the present invention.
FIG. 21 is one example of a display appearance in a display unit 15 according to the second embodiment of the present invention.

FIG. 20 is a configuration diagram of the collaboration control unit 14. As shown in FIG. 20, the collaboration control unit 14 includes a measurement unit 141, a memory unit 142, a selector 143, or an instruction generator 144.

The measurement unit 141 measures thermal stability of each of the first showcase 53, the second showcase 54, and the third showcase 55, in the case in which the amount of the refrigerant supplied is decreased. In the second embodiment, after cooling the temperature inside of the compartment to the lower limit temperature TL, the measurement unit 141 measures time required to reach the upper limit temperature TH (hereinafter referred to "time required for temperature rise $t_R$") from the lower limit temperature TL in the case in which the set temperature is set as the upper limit temperature TH, for each of the first showcase 53, the second showcase 54, and the third showcase 55. It can be determined that the longer the time required for temperature rise $t_R$ is, the higher the thermal stability is.

First, the measurement unit 141 checks that each set temperature of the first showcase 53, the second showcase 54, and the third showcase 55 is the standard temperature TS.

Figures 22, 23:
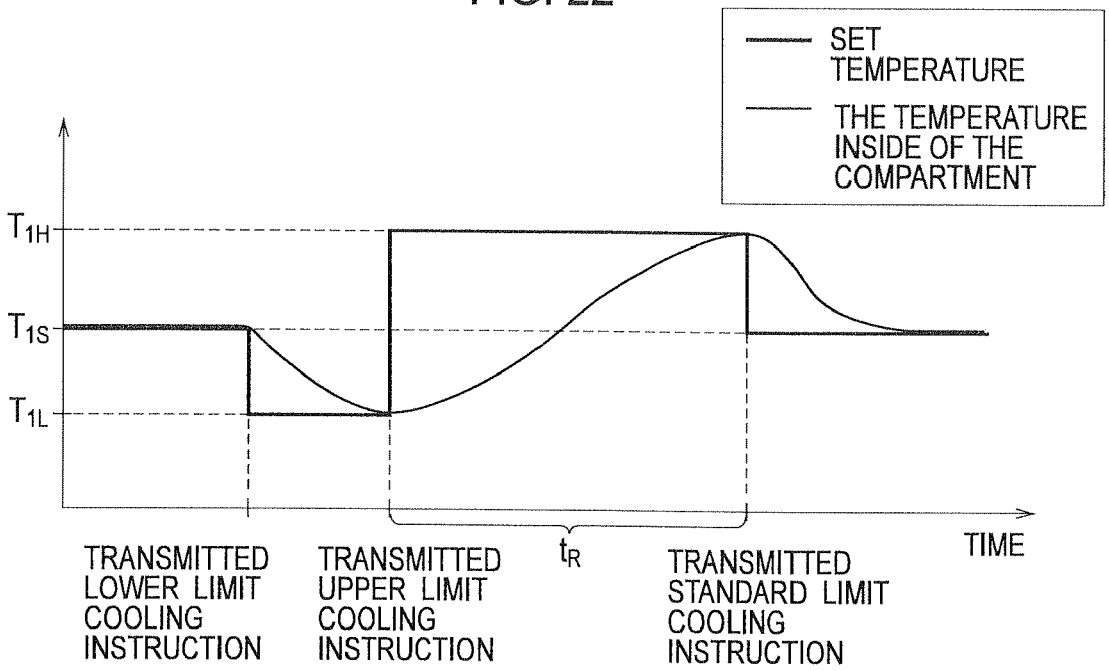
FIG. 22 is a graph showing a successive transition of the set temperature and the temperature inside of the compartment of the first showcase 53 according to the second embodiment of the present invention.
FIG. 23 is a view showing information stored in a memory unit 142 according to the second embodiment of the present invention.

Then, the measurement unit 141 causes the display unit 15 to display device information (showcase No., average recovery time, articles, or the like) indicating the first showcase 53, the second showcase 54, and the third showcase 55, respectively. FIG. 21 is one example of display appearance in the display unit 15. After checking the display unit 15, a user selects a showcase the time required for temperature rise $t_R$ of which he/she measures, by input operation using an input unit 16. Specifically, as shown in FIG. 21, the user enters "selection mark (check mark)" in the showcase whose time required for temperature rise $t_R$ he/she measures, and presses "Determine" button. In response to the "Determine" button being pressed, the measurement unit 141 sequentially starts measurement for all of the selected showcases. A case in which the time required for temperature rise $t_{R1}$ of the first showcase 53 is measured will be described hereinafter with reference to FIG. 22. FIG. 22 is a graph showing a successive transition of the set temperature and the temperature inside of the compartment of the first showcase 53.

First, the measurement unit 141 causes the instruction generator 144 to generate a "lower limit cooling instruction" indicating that the temperature inside of the compartment should be set to the lower limit temperature $T_{1L}$. The "lower limit cooling instruction" is transmitted to the first device controller 40*a* by the transmitter/receiver 13.

Then, when it is confirmed that the temperature inside of the compartment transmitted from the first device controller 40*a* has reached the lower limit temperature $T_{1L}$, the measurement unit 141 sets the temperature inside of the compartment to the upper limit temperature $T_{1H}$, that is, causes the instruction generator 144 to generate an "upper limit cooling instruction" indicating that the amount of the refrigerant supplied will be decreased. The "upper limit cooling instruction" is transmitted to the first device controller 40*a* by the transmitter/receiver 13.

Then, when it is confirmed that the temperature inside of the compartment transmitted from the first device controller 40*a* has reached the upper limit temperature $T_{1H}$, the measurement unit 141 causes the instruction generator 144 to generate a "standard cooling instruction" indicating that the temperature inside of the compartment should be set to the standard temperature $T_{1S}$. The "standard cooling instruction" is transmitted to the first device controller 40*a* by the transmitter/receiver 13.

The measurement unit 141 measures the time required for temperature rise $t_{R1}$ of the first showcase 53. Specifically, the measurement unit 141 measures time for the temperature inside of the compartment of the first showcase 53 to reach the upper limit temperature $T_{1H}$ from the lower limit temperature $T_{1L}$, that is, time from transmission of the "upper limit cooling instruction" to transmission of the "standard cooling instruction".

The measurement unit 141 associates the measured time required for temperature rise $t_{R1}$ with the ambient temperature of the first showcase 53 during measurement, and stores them in the memory unit 142. In addition, the measurement unit 141 acquires the ambient temperature of the first showcase 53 that the sensor 53*b* outputs, from the first device controller 40*a*. When the ambient temperatures have been acquired more than once within a measurement period, an average value of more than one ambient temperature is made to be the ambient temperature of the first showcase 53.

In addition, similar to the measurement of the time required for temperature rise $t_{R1}$ of the first showcase 53, the measurement unit 141 measures time required for temperature rise $t_{R2}$ of the second showcase 54 and time required for temperature rise $t_{R3}$ of the third showcase 55. The measurement unit 141 associates the measured time required for temperature rise $t_{R2}$ with the ambient temperature of the second showcase 54 during measurement, and stores them in the memory unit 142. The measurement unit 141 also associates the measured time required for temperature rise $t_{R3}$ with the ambient temperature of the third showcase 55 during measurement, and stores them in the memory unit 142. In addition, the time required for temperature rise $t_R$ may vary during opening hours of the shop S. Thus, preferably, the measurement unit 141 measures the time required for temperature rise $t_R$ regularly or irregularly.

FIG. 23 is a view showing information stored in the memory unit 142. Generally, as shown in FIG. 23, the higher the ambient temperature is, the shorter the time required for temperature rise $t_R$ is.

When the frost removing operation is performed in one of the first showcase 53, the second showcase 54, and the third showcase 55, the selector 143 selects, from the other two showcases, the showcase whose thermal stability is relatively high in the case where the amount of the refrigerant supplied is decreased (hereinafter referred to as "stable cooling device"). In the second embodiment, the selector 143 selects the showcase whose time required for temperature rise $t_R$ is relatively long as the stable cooling device. As described later, for the selected showcase, the amount of the refrigerant is controlled in conjunction with the showcase in which the frost removing operation is performed. In addition, in this embodiment, the "stable cooling device" is the "second cooling device" according to the present invention.

For example, when the frost removing operation is performed in the first showcase 53, the selector 143 refers to the memory unit 142, and selects, from the second showcase 54 and the third showcase 55, any showcase having longer time required for temperature rise $t_R$. When the ambient temperature of the second showcase 54 is 19° C. and the ambient temperature of the third showcase 55 is 17° C., as shown in FIG. 23, the time required for temperature rise $t_{R2}$ is longer than the time required for temperature rise $t_{R3}$. Thus, the selector 143 selects the second showcase 54.

Then, the selector 143 causes the display unit 15 to display the device information (showcase No., time required for temperature rise $t_R$, articles, etc.) indicating the first showcase 53, the second showcase 54, and the third showcase 55, respectively. FIG. 24 is one example of a display appearance in the display unit 15. As shown in FIG. 24, the first showcase 53 in which the frost removing operation is to be performed and the second showcase 54 selected by the selector 143 are displayed distinctly from the third showcase 55. After checking the display unit 15, a user selects a showcase controlled in collaboration with the first showcase 53 in which the frost removing operation is performed, through the input operation using the input unit 16. When the user selects the second showcase 54 following the selection by the selector 143, he/she presses "Determine" button. In contrast, when the user selects the third showcase 55 against the selection by the selector 143, he/she clears a "check mark" of the second showcase 54, adds a "check mark" to the third showcase 55, and presses "Determine" button. In the second embodiment, the selection of the second showcase 54 is assumed to be confirmed.

As described above, the instruction generator 144 generates the "lower limit cooling instruction", the "upper limit cooling instruction", or the "standard cooling instruction", depending on a request of the measurement unit 141.

In addition, when frost removal start time for the first showcase 53 comes, the instruction generator 144 not only generates an "instruction to start frost removal" instructing the first device controller 40*a* to start to perform the frost removing operation, but also transmits a "lower limit cooling instruction (increase instruction)" indicating to the second device controller 40*b* that it should increase the amount of the refrigerant supplied to the second showcase 54. The "lower limit cooling instruction (increase instruction)" includes the temperature information indicating the lower limit temperature $T_{2L}$ of the second showcase 54. If the lower limit temperature $T_{2L}$ is set to the set temperature in the second device controller 40*b*, the second device controller 40*b* increases the aperture ratio of the solenoid valve 54*a* because the temperature inside of the compartment is higher than the set temperature. This will increase the amount of the refrigerant supplied to the second showcase 54.

In addition, when the instruction generator 144 acquires a "frost removal end notice" indicating that performance of the frost removing operation ends, from the first device controller 40*a* via the transmitter/receiver 13, the instruction generator 144 generates an "upper limit cooling instruction (decrease instruction)" indicating to the second device controller 40*b* that it should decrease the amount of the refrigerant supplied to the second showcase 54. In the second embodiment, the "upper limit cooling instruction (decrease instruction)" includes temperature information indicating the upper limit temperature $T_{2H}$ of the second showcase 54. If the upper limit temperature $T_{2H}$ is set to the set temperature in the second device controller 40*b*, the second device controller 40*b* decreases the aperture ratio of the solenoid valve 54*a* because the temperature inside of the compartment is lower than the set temperature. This will decrease the amount of the refrigerant supplied to the second showcase 54.

In addition, when the instruction generator 144 acquires a "recovery end notice" indicating that an execution of the recovery operation ends, from the first device controller 40*a* via the transmitter/receiver 13, the instruction generator 144 generates the "standard cooling instruction" instructing the second device controller 40*b* to perform the cooling operation at the standard temperature $T_{2S}$. The "standard cooling instruction" includes the temperature information indicating the standard temperature $T_{2S}$ of the second showcase 54. If the standard temperature $T_{2S}$ is set to the set temperature in the second device controller 40*b*, the second device controller 40*b* increases the aperture ratio of the solenoid valve 54*a* because the temperature inside of the compartment is higher than the set temperature.

(3) Operation of an Integrated Control Apparatus

Figure 25:
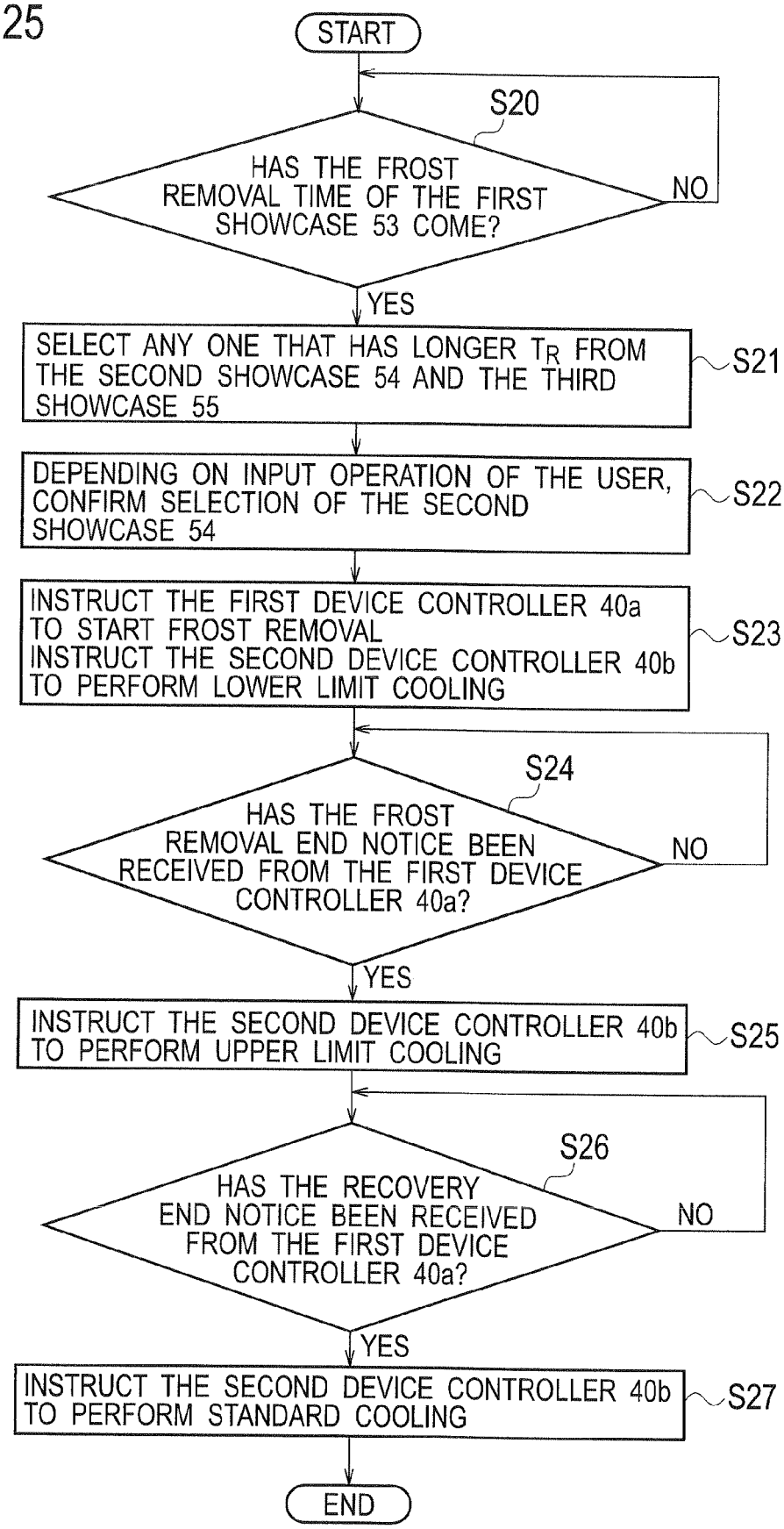
FIG. 25 is flow chart showing an operation of the integrated control apparatus 10 according to the second embodiment of the present invention.

FIG. 25 is a flow chart showing the operation of the integrated control apparatus 10. In addition, FIG. 25 shows a case where the frost removing operation of the first showcase 53 is performed.

In step S20, the integrated control apparatus 10 determines whether or not frost removal start time of the first showcase 53 has come. If the frost removal start time has come, the integrated control apparatus 10 proceeds to the process of step S21. In contrast, if the frost removal start time has not come, the integrated control apparatus 10 performs step S20 repeatedly.

In step S21, the integrated control apparatus 10 selects, from the second showcase 54 and the third showcase 55, the showcase (stable cooling device) whose thermal stability is relatively high in the case where the amount of the refrigerant supplied is decreased. In the second embodiment, as shown in FIG. 23, as the time required for temperature rise $t_{R2}$ is relatively longer than the time required for temperature rise $t_{R3}$, the integrated control apparatus 10 selects the second showcase 54 as a stable cooling device.

In step S22, the integrated control apparatus 10 displays device information indicating the first showcase 53, the second showcase 54, and the third showcase 55, and confirms selection of the showcase to be controlled in conjunction with the first showcase 53 in which the frost removing operation is performed, depending on user's input operation. In the second embodiment, selection of the second showcase 54 is confirmed.

In step S23, the integrated control apparatus 10 not only transmits an "instruction to start frost removal" to the first device controller 40*a* (device control unit 43), but also transmits a "lower limit cooling instruction" to the second device controller 40*b* (device control unit 43).

In step S24, the integrated control device 10 determines whether or not it has received a "frost removal end notice" from the first device controller 40*a* (device control unit 43). If the integrated control apparatus 10 has received the "frost removal end notice", it proceeds to the process of step S25. In contrast, if the integrated control apparatus 10 has not received the "frost removal end notice", it repeatedly performs step S24.

In step S25, the integrated control apparatus 10 transmits an "upper limit cooling instruction" to the second device controller 40*b* (device control unit 43).

In step S26, the integrated control apparatus 10 determines whether or not it has received a "recovery end notice" from the first device controller 40*a* (device control unit 43). If the integrated control apparatus 10 has received the "recovery end notice", it proceeds to the process of step S27. In contrast, if the integrated control apparatus 10 has not received the "recovery end notice", it repeatedly performs step S26.

In step 27, the integrated control apparatus 10 transmits a "standard cooling instruction" to the second device controller 40*b* (device control unit 43).

(4) Advantageous Effect

The integrated control apparatus 10 according to the second embodiment not only provides the second device controller 40*b* with the "lower limit cooling instruction" in response to the start of the frost removing operation of the first showcase 53, but also provides the second device controller 40*b* with the "upper limit cooling instruction" in response to the end of the frost removing operation of the first showcase 53.

In this way, the second device controller 40*b* increases the amount of the refrigerant supplied to the second showcase 54, in response to the start of the frost removing operation of the first showcase 53. That is, after the frost removing operation of the first showcase 53 starts, the inside of the compartment of the second showcase 54 is cooled down to temperature lower than normal cooling condition (lower limit temperature $T_{2L}$). Thus, when the amount of the refrigerant supplied to the second showcase 54 is decreased after the frost removing operation of the first showcase 53 ends, excessive elevation of the temperature inside of the compartment of the second showcase 54 can be suppressed. Consequently, the inside of the compartment of the first showcase 53 can be recovered to the normal cooling condition in a small amount of time, while maintaining the inside of the compartment of the second showcase 54 in good cooling condition. Hence, freshness or quality of the articles displayed in the first showcase 53 and the second showcase 54 can be maintained.

In addition, the integrated control apparatus 10 according to the second embodiment includes the selector 143 configured to select the second showcase 54 whose thermal stability is relatively high in the case where the amount of the refrigerant supplied is decreased, compared with the third showcase 55. Specifically, the selector 143 selects, from the second showcase 54 and the third showcase 55, any showcase having longer time required for temperature rise $t_R$, as a showcase controlled to collaborate with the first showcase 53 in which the frost removing operation is performed.

Therefore, it is able to select the second showcase 54 whose temperature inside of the compartment gradually rises when the amount of the refrigerant is decreased. Thus, if the amount of the refrigerant supplied to the second showcase 54 is decreased after the frost removing operation of the first showcase 53 ends, freshness or quality of the articles displayed in the second showcase 54 can be maintained effectively.

In addition, the integrated control apparatus 10 according to the second embodiment selects the showcase (stable cooling device) whose thermal stability is relatively high, on the basis of the time required for temperature rise $t_R$ corresponding to the ambient temperature when the frost removing operation starts. Thus, the integrated control apparatus 10 can select the showcase, considering variations in the time required for temperature rise $t_R$ corresponding to the ambient temperature. Consequently, accuracy of selecting an appropriate showcase as a showcase to be controlled to collaborate with the first showcase 53 in which the frost removing operation is performed can be improved.

In addition, the integrated control apparatus 10 according to the second embodiment includes the display unit 15 configured to display information showing the first showcase 53 in which the frost removing operation is performed and information showing the selected second showcase 54, distinctly from information indicating the first showcase 53, the second showcase 54, and the third showcase 55. Thus, the user can check whether or not the showcase selected by the selector 143 is appropriate as a showcase to be controlled in conjunction with the first showcase 53 in which the frost removing operation is performed. Therefore, the accuracy of selecting an appropriate showcase as the showcase to be controlled in conjunction with the first showcase 53 in which the frost removing operation is performed can be further improved.

Third Embodiment

An integrated control apparatus 10 according to a third embodiment of the present invention will be described hereinafter with reference to the drawings. In the following, differences from the second embodiment described above will be mainly described. Specifically, a selector 148 according to the third embodiment selects, from a second showcase 54 and a third showcase 55, any showcase having a relatively large heat capacity of an entire showcase, as the stable cooling device. In addition, in the following, similar to the second embodiment described above, a case in which a frost removing operation of a first showcase 53 is performed will be described.

(1) Configuration of Collaboration Control Unit

Figure 26:
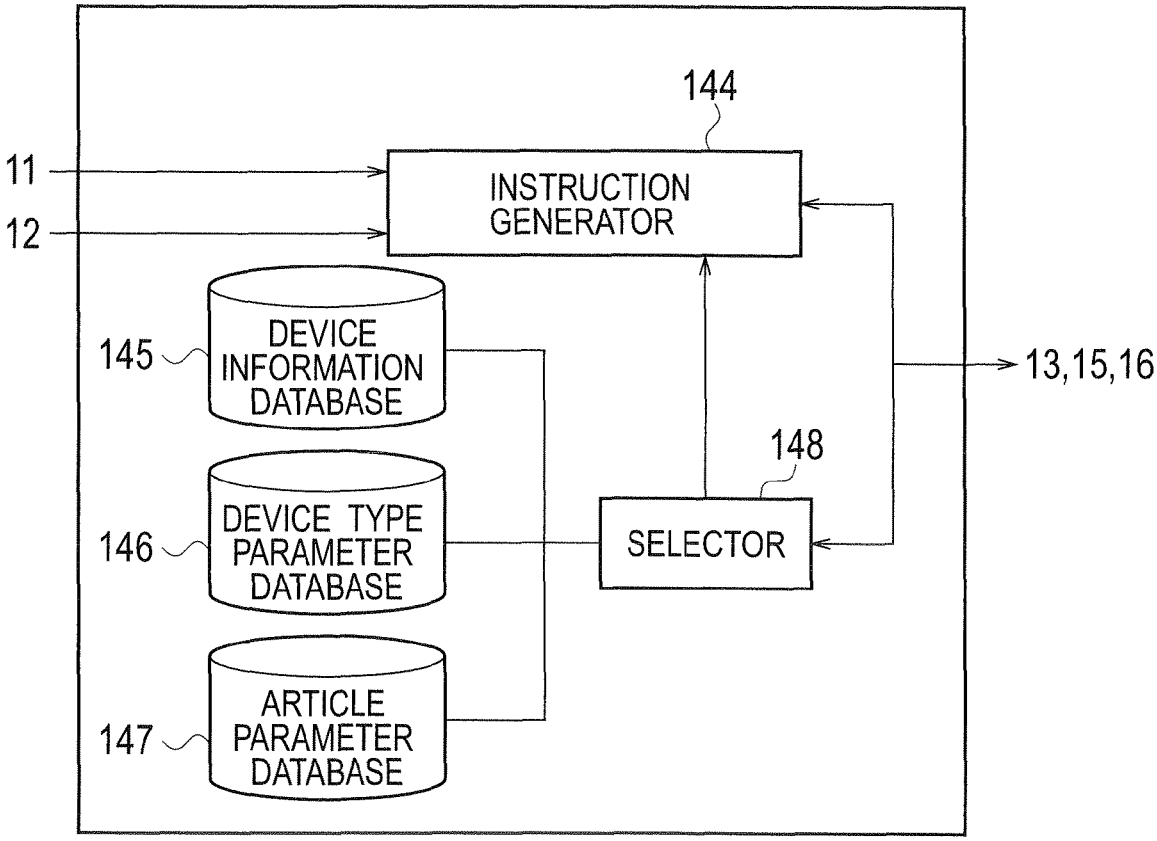
FIG. 26 is a configuration diagram of the collaboration control unit 14 according to a third embodiment of the present invention.

FIG. 26 is a configuration diagram of a collaboration control unit 14 according to the third embodiment. As shown in FIG. 26, the collaboration control unit 14 includes an instruction generator 144, a device information database 145, a device type parameter database 146, an article parameter database 147, and a selector 148.

FIG. 27 is a database configuration diagram of the device information database 145. As shown in FIG. 27, the device information database 145 associates a device type code, which is a model number of a showcase, with articles displayed in the compartment, and stores them, for the first showcase 53, the second showcase 54, and the third showcase 55, respectively.

FIG. 28 is a database configuration diagram of the device type parameter database 146. As shown in FIG. 28, the device type parameter database 146 associates a device type code of each of the first showcase 53, the second showcase 54, and the third showcase 55 with a device type parameter Pt and stores them. The device type parameter Pt is one index indicative of heat capacity of the entire showcase, and determined based on shape, capacity, sealability (presence of a door) or the like of a showcase. The larger the shape and the capacity of the showcase are, the larger the device type parameter Pt is. Moreover, the higher the sealability of the showcase is, the larger the device type parameter Pt is. Therefore, the larger the device parameter Pt is, the larger the heat capacity of the entire showcase is.

FIG. 29 is a database configuration diagram of the article parameter database 147. As shown in FIG. 29, the article parameter database 147 associates the articles with an article parameter Pg and stores them. The article parameter Pg is one index indicative of heat capacity of the entire showcase, and is determined on the basis of a type of an article, a quantity of an article, or a volume of one article or the like. The article parameter Pg tends to be larger if an article is a beverage and smaller if it is dried foodstuff. As the article parameter Pg takes a larger value, the entire showcase has higher thermal stability, i.e., a larger heat capacity.

The selector 148 according to the third embodiment computes a heat capacity parameter Pc indicative of heat capacity of an entire showcase, on the basis of the device type parameter Pt and the article parameter Pg.

First, the selector 148 acquires the device type parameter Pt and the article parameter Pg for the second showcase 54 and the third showcase 55, respectively. The selector 148 computes the heat capacity parameter Pc by assigning the device parameter Pt and the article parameter Pg to a predetermined heat capacity parameter computing function F.

Next, the selector 148 selects, from the second showcase 54 and the third showcase 55, a showcase having a larger heat capacity parameter Pc, as the stable cooling device.

Then, the selector 148 notifies the instruction generator 144 of a selected showcase. In addition, the third embodiment is similar to the second embodiment as described above, except for the method of selection in the selector 148.

(2) Advantageous Effect

The integrated control apparatus 10 according to the third embodiment has the selector 148 that selects a showcase with relatively high thermal stability, i.e., a relatively large heat capacity as a whole, as the stable cooling device.

Therefore, the selector 148 can select a showcase whose temperature inside of the compartment rises gradually when the amount of the refrigerant is reduced. Thus, even if the amount of the refrigerant supplied to the selected showcase is reduced after the frost removing operation of the first showcase 53 ends, freshness or quality of the articles displayed in the showcase can be maintained more effectively.

In addition, the selector 148 computes heat capacity of an entire showcase, corresponding to the heat capacity parameter Pc based on the device type parameter Pt and the article parameter Pg. Thus, since there is no process that should be done before the frost removing operation in the first showcase 53, processing load on the integrated control apparatus 10 can be reduced.

[Modification of Third Embodiment]

A modification of the third embodiment of the present invention will be described hereinafter with reference to the drawings. In the following, differences from the third embodiment described above will be mainly described.

(1) Configuration of Collaboration Control Unit

Figure 30:
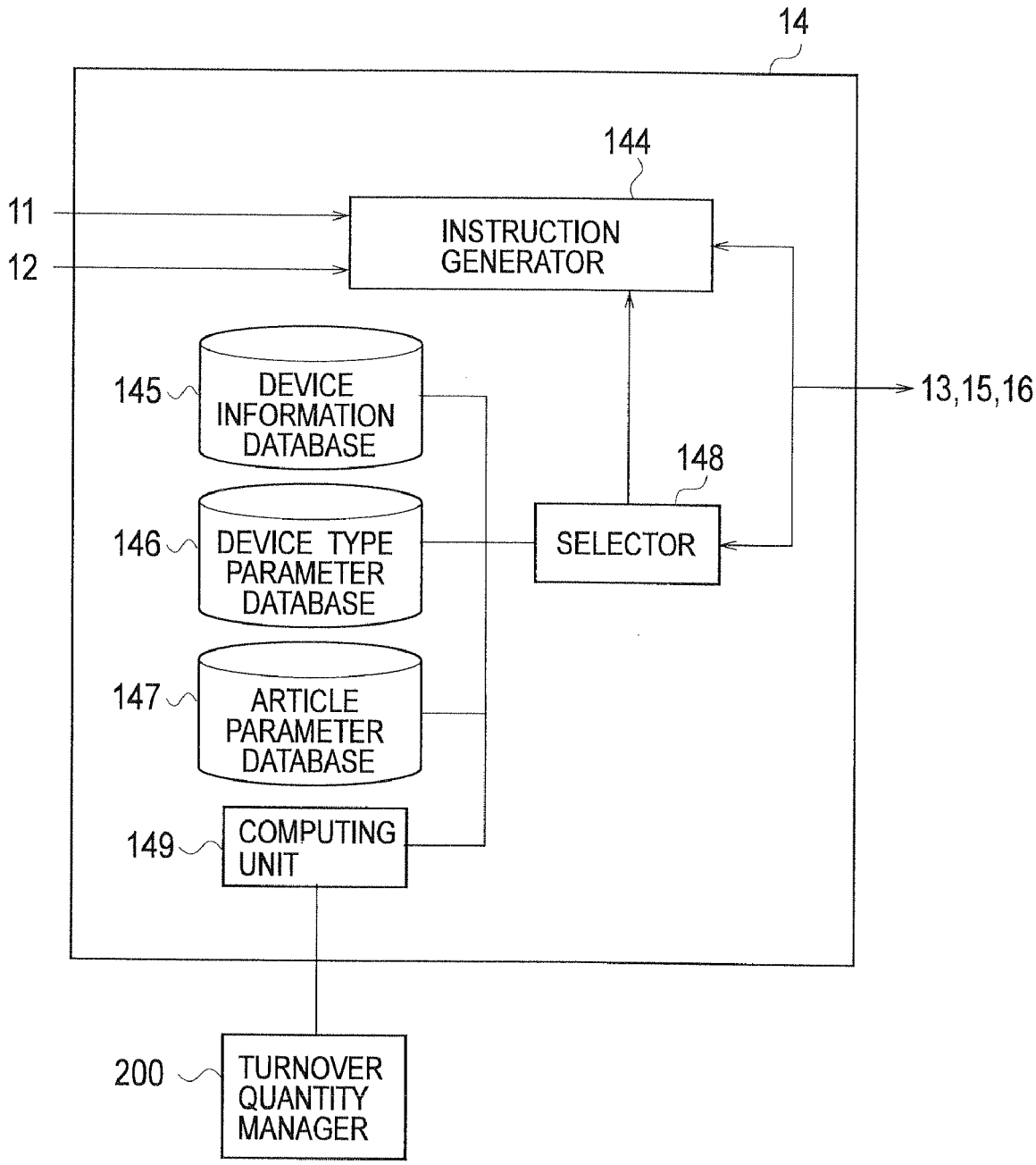
FIG. 30 is a configuration diagram of the collaboration control unit 14 according to a modification of the third embodiment of the present invention.

FIG. 30 is a configuration diagram of the collaboration control unit 14 according to the modification of the third embodiment. As shown in FIG. 30, the collaboration control unit 14 includes a computing unit 149 connected to a turnover quantity manager 200.

The turnover quantity manager 200 manages a turnover quantity of articles of each showcase, that is, a sales quantity and refilled quantity of articles.

The computing unit 149 acquires a display quantity of articles in each showcase, according to the turnover quantity of articles of the showcase, and computes a display quantity parameter Pr based on the display quantity for each showcase. The larger the display quantity is, the larger the display quantity parameter Pr is, and the higher thermal stability, i.e., the larger heat capacity the entire showcase has.

In the modification, the selector 148 computes the heat capacity parameter Pc for each showcase by assigning the device parameter Pt, the article parameter Pg and the display quantity parameter Pr to a predetermined heat capacity parameter computing function F'. From the second showcase 54 and the third showcase 55, the selector 148 selects a showcase having a larger heat capacity parameter Pc, as the stable cooling device.

In addition, as the turnover quantity manager 200, a POS system (Point Of Sales system) provided in a shop S or the like can be used. With the POS system, the turnover quantity of articles can be sequentially acquired.

(2) Advantageous Effect

According to the modification, the display quantity parameter Pr is computed based on the turnover quantity of articles acquired through the turnover quantity manager 200. The selector 148 selects the stable cooling device on the basis of the heat capacity parameter Pc calculated according to the device parameter Pt, the article parameter Pg and the display quantity parameter Pr.

Use of the heat capacity parameter Pc allows the thermal stability of each showcase to be identified with higher accuracy. Thus, a showcase having a higher thermal stability is correctly selected.

Other Embodiments

As described above, the present invention was described with the embodiments, it should not be understood that a descriptions and drawings forming a part of the disclosure limit the present invention. Various alternative embodiments, examples, and operating techniques will become apparent from this disclosure.

For example, in the above embodiment, although three showcases of the first showcase 53, the second showcase 54, and the third showcase 55 are arranged in the shop S, the arrangement is not limited to this. More than three showcases may be arranged in the shop S. Note that, if a number of showcases are arranged in the shop S, there is a possibility that a frost removing operation is performed around the same time, and hence a recovery operation may be performed around the same time in two or more showcases. Thus, it is preferable to exclude, from selection targets of the selector 143, another showcase in which the frost removing operation is started within a predetermined period of time from the start of the frost removing operation in one showcase.

In addition, although it is not mentioned, in particular, in the above embodiment, a "temperature inside of the compartment" of a showcase may be an average temperature inside of the compartment of the showcase per predetermined time.

In addition, although nothing is mentioned, in particular, in the above embodiment, the integrated control apparatus 10 may exclude, from the choice of the "second cooling device" according to the present invention, a showcase in which the frost removing operation is started within a predetermined period of time, or a showcase for which the predetermined period of time has not elapsed since the end of cooling operation at an upper limit temperature. This enables quality and freshness of articles displayed in showcases to be maintained.

In addition, in the above embodiment, although frost removal start time in each showcase is given, it is not limited to this. For example, the frost removing operation in each showcase may be performed based on an input operation of a user.

In addition, in the above embodiment, the first device controller 40*a*, the second device controller 40*b*, and the third device controller 40*c* are provided outside of the first showcase 53, the second showcase 54, and the third showcase 55, but they are not limited to this. For example, the first device controller 40*a*, the second device controller 40*b*, and the third device controller 40*c* may be provided in the integrated control apparatus 10. Alternatively, the device controllers may be integrally provided with the showcases, respectively. In addition, one device controller may control valves of multiple showcases.

In addition, in the above embodiment, although the solenoid valve 53*a* is provided in the first showcase 53, it may be provided outside of the first showcase 53. Additionally, the solenoid valve 54*a* may be provided outside of the second showcase 54, and the solenoid valve 55*a* may be provided outside of the showcase 55.

In addition, in the above embodiment, although a set temperature of the first showcase 53 during recovery operation is a standard temperature $T_{1S}$, the set temperature during the recovery operation may be a temperature lower than the standard temperature $T_{1S}$. In this case, since a temperature difference between the temperature inside of the compartment and the set temperature can be retained for a long time, the aperture ratio of the solenoid valve 53*a* can be kept large for a long time. Consequently, the recovery operation of the first showcase 53 can be completed in a short time.

In addition, although the solenoid valves 53*a*, 54*a*, 55*a* are used as a valve for adjusting the supply amount of the refrigerant in the above embodiment, it is not limited to a solenoid valve as far as it adjusts the supply amount of the refrigerant.

In addition, although a "lower limit cooling instruction (instruction to increase)" and an "upper limit cooling instruction (instruction to decrease)" include temperature information in the above embodiment, they may include the aperture ratio information indicating the aperture ratio of a solenoid valve or the like, instead of the temperature information.

In addition, although the second device controller 40*b* sets the set temperature of the second showcase 54 to the upper limit temperature $T_{2H}$ during the recovery operation of the first showcase 53 in the above embodiment, the second device controller 40*b* may set the set temperature of the second showcase 54 to the standard temperature $T_{2S}$. Also, in this case, the amount of the refrigerant supplied to the second showcase 54 is reduced by reducing the aperture ratio of the solenoid valve 54*a*.

In addition, although the integrated control apparatus 10 controls the frost removing operation in each showcase in the above embodiment, the control of the frost removing operation is not limited to this. For example, each device controller may control the frost removing operation in each showcase. In this case, the integrated control device 10 detects a start of the frost removing operation in the first device controller 40*a* by a "frost removal start notice" transmitted from the first device controller 40*a*, for example, and transmits a "lower limit cooling instruction (increase instruction)" to the second device controller 40*b*.

In addition, although the control system 1 includes the first device controller 40*a*, the second device controller 40*b*, the third device controller 40*c*, and the integrated control apparatus 10 in the above embodiment, the first device controller 40*a*, the second device controller 40*b*, and the third device controller 40*c* may be included in the integrated control apparatus 10.

In addition, although a description is given by citing a pair of the first showcase 53 and the second showcase 54 in the above first embodiment, three or more showcases may be connected to the integrated control apparatus 10. For example, one showcase may operate as a first showcase 53, and a part or all of the other showcases may operate as a second showcase 54. In this case, by reducing the amount of the refrigerant supplied to the showcase(s) that operate(s) as the second showcase 54 while the showcase that operates as the first showcase 53 is performing the recovery operation, the amount of the refrigerant supplied to the showcase that operates as the first showcase 53 can be increased. Consequently, recovery time of the showcase that operates as the first showcase 53 can be reduced. Alternatively, multiple showcases may operate as a first showcase 53, and one or more showcase may operate as a second showcase 54. Even in this case, the effect similar to the above can be achieved.

In addition, although nothing is mentioned, in particular, in the first embodiment described above, the integrated control apparatus 10 may store pull-down time of when performing the frost removing operation in one showcase, for each showcase that is notified of the lower limit and upper limit cooling instructions (hereinafter referred to as "target to be notified"). Specifically, as shown in FIG. 31, the integrated control apparatus 10 stores the pull-down time of showcases in which the frost removing operation is performed (hereinafter referred to as "target of frost removal"), for every target to be notified. In the example of FIG. 31, when the frost removing operation of the first showcase 53 is performed, the pull-down operation of the first showcase 53 can be reduced if the second showcase 54, rather than the third showcase 55, is set as a target to be notified. The integrated control apparatus 10 can efficiently perform the pull-down operation of the first showcase 53 by selecting a showcase with shorter pull-down time as a target to be notified, depending on a target of frost removal. Furthermore, as in the modification of the first embodiment, even when a showcase to which the upper limit cooling instruction is notified is selected during the pull-down operation, the pull-down operation of the first showcase 53 can be performed more efficiently by selecting a showcase with shorter pull-down time.

In addition, although nothing is mentioned, in particular, in the first embodiment as described above, the integrated control apparatus 10 may include a memory unit for storing a showcase made to be the second showcase 54 during the frost removing operation of the first showcase 53, if multiple (four or more) showcases are arranged in the shop S. During the next frost removing operation of the first showcase 53, the integrated control apparatus 10 can select the showcase stored in the memory unit as the second showcase 54.

In addition, although nothing is mentioned, in particular, in the modification of the first embodiment as described above, the integrated control apparatus 10 may select, as a third showcase 55, a showcase with the highest thermal stability from multiple (four or more) showcases excluding the first and the second showcases 53, 54, if the multiple (four or more) showcases are arranged in the shop S. In addition, as described above, the third showcase 55 is a "third cooling device" according to the present invention.

In addition, although selection of the second showcase 54 by the integrated control apparatus 10 is confirmed by input operation of the user in the second embodiment as described above, it is not limited to this. For example, selection may be automatically confirmed without display on the input screen or input operation of the user, or may be automatically confirmed after a predetermined period of time has elapsed since the display on the input screen.

In addition, although nothing is mentioned, in particular, in the second embodiment as described above, the integrated control apparatus 10 may include a memory unit for storing a showcase made to be the third showcase 55 during the frost removing operation of the first showcase 53, if multiple (four or more) showcases are arranged in the shop S. In addition, the integrated control apparatus 10 may select the showcase stored in the memory unit, as a second showcase 54, during the next frost removing operation of the first showcase 53.

In addition, although nothing is mentioned, in particular, in the second embodiment as described above, the integrated control apparatus 10 may exclude a showcase registered by the user in advance from the choices or select an appropriate showcase considering priority of the showcases registered by the user in advance.

In addition, although nothing is mentioned, in particular, in the second embodiment as described above, the selectors 143, 148 may select a showcase having a relatively short distance from a refrigerant supply side (condenser 52) of a refrigerant supplying device 60, as a showcase with relatively high thermal stability. Specifically, as shown in FIG. 13, when frost removing operation is performed for the first showcase 53, the selectors 143, 148 may select the second showcase 54 that is closer to the condenser 52 than the third showcase 55. Since the refrigerant are sequentially supplied to the showcases, starting with the showcase that is closer to the refrigerant supplying device 60, the refrigerant is more easily supplied to the second showcase 54 than to the third showcase 55, the second showcase 54 being closer to the refrigerant supply side of the refrigerant supplying device 60. Thus, by reducing the amount of the refrigerant supplied to the second showcase 54, more refrigerant can be supplied to the first showcase 53 in which the recovery operation is performed. Consequently, the recovery time in the first showcase 53 can be reduced further.

In addition, although nothing is mentioned, in particular, in the second embodiment as described above, it is preferable that the integrated control apparatus 10 selects the third showcase 55 in addition to the second showcase 54 when the next frost removing operation is performed in the first showcase 53, if the recovery operation in the first showcase 53 is not completed within time required for temperature rise $t_{R2}$ of the second showcase 54. This can prevent occurrence of an event that the refrigerant supplied to the second showcase 54 during the recovery operation of the first showcase 53 should be increased.

In addition, in the above second embodiment, although a description is given by citing a triplet of the first showcase 53, the second showcase 54, and the third showcase 55, four or more showcases may be connected to the integrated control apparatus 10. For example, one showcase may operate as the first showcase 53, and a part or all of other showcases may operate as the second showcase 54. In this case, while the showcase that operates as the first showcase 53 is performing the recovery operation, the amount of the refrigerant supplied to the showcase that operates as the first showcase 53 can be increased by reducing the amount of the refrigerant supplied to the showcase(s) that operate(s) as the second showcase 54. Consequently, recovery time of the showcase that operates as the first showcase 53 can be reduced. Alternatively, multiple showcases may operate as the first showcase 53, and one or more showcases may operate as the second showcase 54. Even in this case, the effect similar to the above can be achieved.

In addition, each process described in the above embodiments can be incorporated as a computer program and executed by a computer acting as the integrated control apparatus 10.

Thus, it should be understood that the present invention includes various embodiments or the like which are not described herein. Hence, the present invention shall be defined only by the inventive specified matters related to the scope of claims, which are appropriate from this disclosure.

What is claimed is:

1. A control system comprising a first cooling device configured to cool a first cooled space;

a second cooling device configured to cool a second cooled space;

a refrigerant supplying device configured to supply a refrigerant to the first cooling device and the second cooling device;

an integrated control apparatus configured to detect or control a frost removing operation for removing frost attached to the first cooling device; and a device control unit configured to control an amount of the refrigerant supplied to the second cooling device, wherein the integrated control apparatus includes a transmitter for transmitting an increase instruction to the device control unit in response to a start of the frost removing operation, the increase instruction instructing the device control unit to increase the refrigerant supplied to the second cooling device, to an amount larger than that before the frost removing operation starts, and the device control unit increases the amount of the refrigerant supplied to the second cooling device, according to the increase instruction.

2. The control system according to claim 1, wherein in response to an end of the frost removing operation, the transmitter transmits a decrease instruction to the device control unit, the decrease instruction instructing the device control unit to decrease the refrigerant supplied to the second cooling device, to an amount smaller than that before the frost removing operation ends, and the device control unit reduces the amount of the refrigerant supplied to the second cooling device, according to the decrease instruction.

3. The control system according to claim 1, further comprising a valve capable of adjusting the amount of the refrigerant supplied to the second cooling device, wherein the device control unit controls an aperture ratio of the valve according to the instruction.

4. The control system according to claim 3, wherein the instruction includes temperature information indicating a set temperature in the second cooled space, and the device control unit controls the aperture ratio of the valve according to the temperature information.

5. The control system according to claim 3, wherein the device control unit computes the aperture ratio on the basis of an opening area of the valve.

6. The control system according to claim 3, wherein the device control unit computes the aperture ratio on the basis of opening time per unit time of the valve.

7. The control system according to claim 2, comprising a third cooling device configured to cool a third cooled space; and an another device control unit configured to control an amount of the refrigerant supplied to the third cooing device, wherein when a temperature in the second cooled space reaches a predetermined temperature, the transmitter transmits an decrease instruction to the another device control unit, the decrease instruction instructing the another device control unit to decrease the amount of the refrigerant supplied to the third cooling device, and the another device control unit decreases the amount of the refrigerant supplied to the third cooling device, according to the decrease instruction to decrease the amount of the refrigerant supplied to the third cooling device.

8. The control system according to claim 1, comprising a plurality of cooling devices that include the second cooling device and that are configured to respectively cool a plurality of cooled spaces including the second cooled space, wherein the integrated control apparatus further includes a selector for selecting, from the plurality of cooling devices, the second cooling device as a cooling device having relatively high thermal stability under a condition with a decreased amount of the refrigerant supplied.

9. The control system according to claim 8, wherein in response to an end of the frost removing operation, the transmitter transmits a decrease instruction to the device control unit, the decrease instruction instructing the device control unit to decrease the refrigerant supplied to the second cooling device, to an amount smaller than that before the frost removing operation, and the device control unit decreases the amount of the refrigerant supplied to the second cooling device, according to the decrease instruction.

10. The control system according to claim 8, wherein the integrated control apparatus includes a measurement unit configured to measure a time required for temperature rise for each of the plurality of cooling devices, the time required for temperature rise being time required to raise a temperature in each of the plurality of cooled spaces from a lower limit temperature to an upper limit temperature, the lower and upper limit temperatures being specified for each of the plurality of cooled spaces, and the selector selects a cooling device having the time required for temperature rise that is relatively long, as the second cooling device.

11. The control system according to claim 10, wherein the integrated control apparatus includes a memory unit configured to store, for each of the plurality of cooling devices, an ambient temperature and the time required for temperature rise in association with each other, the ambient temperature being obtained when the time required for temperature rise is measured, and the selector makes a selection from the plurality of cooling devices on the basis of their respective times required for temperature rise that are associated with the ambient temperatures at a time of start of the frost removing operation, and thus selects as the second cooling device a cooling device having the relatively long time required for temperature rise.

12. The control system according to claim 8, wherein the selector computes the thermal stability of each of the plurality of cooling devices, on the basis of the turnover quantity of articles displayed in each of the plurality of cooled spaces.

13. The control system according to claim 1, wherein the selector includes a memory unit in which the second cooling device is registered, and the selector selects the second cooling device registered in the memory unit, as a target to transmit the increase instruction during a frost removing operation of next time.

14. An integrated control apparatus configured to detect or control a frost removing operation in which frost attached to a first cooling device that cools a first cooled space is removed while the first cooled space is receiving supply of refrigerant from a refrigerant supplying device that supplies the refrigerant to a second cooling device that cools a second cooled space, the integrated control apparatus comprising a transmitter configured to provide a device control unit with an increase instruction in response to start of the frost removing operation, the device control unit configured to control an amount of the refrigerant supplied to the second cooling device, the increase instruction instructing the device control unit to increase the refrigerant supplied to the second cooling device, to an amount larger than that before the frost removing operation starts.

15. The integrated control apparatus according to claim 14 comprising a selector configured to select the second cooling device as a cooling device having relatively high thermal stability under a condition with a decreased amount of the refrigerant supplied, from a plurality of cooling devices that include the second cooling device and that are configured to respectively cool a plurality of cooled spaces including the second cooled space.

16. A control program used in a computer functioning as an integrated control apparatus configured to detect or control a frost removing operation in which frost attached to a first cooling device that cools a first cooled space is removed while the first cooled space is receiving supply of refrigerant from a refrigerant supplying device that supplies the refrigerant to a second cooling device that cools a second cooled space, the control program causing the computer to execute an instruction step in response to a start of the frost removing operation, the instruction step comprising issuing an increase instruction to a device control unit configured to control an amount of the refrigerant supplied to the second cooling device, the increase instruction instructing the device control unit to increase the amount of the refrigerant supplied to the second cooling device, to an amount larger than that before the frost removing operation starts.

17. The control program according to claim 16, the program further causing the computer to execute a selection step prior to the instruction step, the selection step comprising selecting the second cooling device as a cooling device having relatively high thermal stability under a condition with a decreased amount of the refrigerant supplied, from a plurality of cooling devices that include the second cooling device and that are configured to respectively cool a plurality of cooled spaces including the second cooled space.

* * * * *